US010510361B2

(12) United States Patent
Nomura

(10) Patent No.: US 10,510,361 B2
(45) Date of Patent: Dec. 17, 2019

(54) AUDIO PROCESSING APPARATUS THAT OUTPUTS, AMONG SOUNDS SURROUNDING USER, SOUND TO BE PROVIDED TO USER

(71) Applicant: Panasonic Intellectual Property Management Co., Ltd., Osaka (JP)

(72) Inventor: Kazuya Nomura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 271 days.

(21) Appl. No.: 15/059,539

(22) Filed: Mar. 3, 2016

(65) Prior Publication Data

US 2016/0267925 A1 Sep. 15, 2016

(30) Foreign Application Priority Data

Mar. 10, 2015 (JP) ..... 2015-046572

(51) Int. Cl.

| | |
|---|---|
| ***G10L 25/84*** | (2013.01) |
| ***G10L 21/0272*** | (2013.01) |
| ***H04R 25/00*** | (2006.01) |
| *G10L 25/81* | (2013.01) |
| *G10L 25/78* | (2013.01) |
| *H04R 1/10* | (2006.01) |

(52) U.S. Cl.

CPC ..... *G10L 25/84* (2013.01); *G10L 21/0272* (2013.01); *H04R 25/407* (2013.01); *G10L 25/78* (2013.01); *G10L 25/81* (2013.01); *H04R 1/1083* (2013.01)

(58) Field of Classification Search

CPC ..... G10L 25/84; G10L 21/0272; G10L 25/78; G10L 25/81; H04R 25/407; H04R 1/1083

USPC ..... 381/94.7

See application file for complete search history.

(56) References Cited

U.S. PATENT DOCUMENTS 7,801,726 B2 * 9/2010 Ariu ..... G10L 25/87 704/208
7,853,026 B2 * 12/2010 DeLine ..... B60R 1/12 381/122
8,194,900 B2 * 6/2012 Fischer ..... H04R 25/407 381/313
8,396,224 B2 * 3/2013 Dittberner ..... H04R 25/40 381/23.1
9,191,744 B2 * 11/2015 Anderson ..... H04R 5/04
9,270,244 B2 * 2/2016 Usher ..... H04R 1/1041

(Continued)

FOREIGN PATENT DOCUMENTS

JP 2005-064744 3/2005
JP 2005064744 A * 3/2005 ..... H04R 25/00

(Continued)

*Primary Examiner* — Oyesola C Ojo
(74) *Attorney, Agent, or Firm* — Greenblum & Bernstein, P.L.C.

(57) ABSTRACT

An audio processing apparatus is provided that includes an acquirer that acquires a surrounding audio signal indicating a sound surrounding a user. The audio processing apparatus also includes an audio extractor that extracts, from the acquired surrounding audio signal, a providing audio signal indicating a sound to be provided to the user. The audio processing apparatus further includes an output that outputs a first audio signal, indicating a main sound, and the providing audio signal.

13 Claims, 11 Drawing Sheets

(56) References Cited

U.S. PATENT DOCUMENTS 9,478,232 B2 * 10/2016 Hirohata ..... G10L 15/20
9,491,553 B2 * 11/2016 Liu ..... H04R 25/40
9,509,269 B1 * 11/2016 Rosenberg ..... G11B 27/105
9,513,866 B2 * 12/2016 Lu ..... H04R 5/04
2006/0182291 A1 * 8/2006 Kunieda ..... G10L 15/00 381/110
2007/0189544 A1 * 8/2007 Rosenberg ..... G11B 27/105 381/57
2007/0223717 A1 * 9/2007 Boersma ..... H04M 1/6058 381/74
2008/0120100 A1 * 5/2008 Takeda ..... G10L 15/20 704/233
2008/0240458 A1 * 10/2008 Goldstein ..... H04R 25/453 381/72
2009/0043588 A1 * 2/2009 Takeda ..... G10L 21/0272 704/278
2009/0304187 A1 * 12/2009 Dittberner ..... H04R 25/40 381/23.1
2010/0290633 A1 * 11/2010 Chen ..... H03G 3/32 381/57
2011/0206345 A1 * 8/2011 Masuo ..... H04N 5/775 386/239
2012/0114155 A1 * 5/2012 Nishizaki ..... H04R 25/43 381/313
2014/0112498 A1 * 4/2014 Zong ..... H04R 3/005 381/107
2014/0126756 A1 * 5/2014 Gauger, Jr. ..... A61F 11/14 1/14
2014/0270200 A1 * 9/2014 Usher ..... H04R 1/1041 381/57
2015/0124975 A1 * 5/2015 Pontoppidan ..... H04R 25/552 381/23.1
2015/0139433 A1 * 5/2015 Funakoshi ..... H04R 3/04 381/71.1
2015/0222999 A1 * 8/2015 Rasmussen ..... A61B 5/16 381/60
2016/0125867 A1 * 5/2016 Jarvinen ..... G10K 11/175 381/73.1
2016/0173049 A1 * 6/2016 Mehta ..... H03G 3/32 381/57

FOREIGN PATENT DOCUMENTS

JP 2005064744 A * 3/2005 ..... H04R 25/00
JP 2005-148434 6/2005
JP 2009-528802 8/2009
JP 2011045125 * 3/2011 ..... G10L 21/0208
JP 2011045125 A * 3/2011 ..... G10L 21/02

* cited by examiner

AUDIO PROCESSING APPARATUS THAT OUTPUTS, AMONG SOUNDS SURROUNDING USER, SOUND TO BE PROVIDED TO USER

BACKGROUND

1. Technical Field

The present disclosure relates to audio processing apparatuses, audio processing methods, and audio processing programs that acquire audio signals indicating sounds surrounding users and carry out predetermined processing on the acquired audio signals.

2. Description of the Related Art

One of the basic functions of hearing aids is to make the voice of a conversing party more audible. To achieve this function, adaptive directional sound pickup processing, noise suppressing processing, sound source separating processing, and so on are employed as techniques for enhancing the voice of the conversing party. Through these techniques, sounds other than the voice of the conversing party can be suppressed.

Portable music players, portable radios, or the like are not equipped with mechanisms for taking the surrounding sounds thereinto and merely play the content stored in the devices or output the received broadcast content.

Some headphones are provided with mechanisms for taking the surrounding sounds thereinto. Such headphones generate signals for canceling the surrounding sounds through internal processing and output the generated signals mixed with the reproduced sounds to thus suppress the surrounding sounds. Through this technique, the user can obtain the desired reproduced sounds while noise surrounding the user of the electronic apparatuses for reproduction is being blocked.

For example, a hearing aid apparatus (hearing aid) disclosed in Japanese Unexamined Patent Application Publication No. 2005-64744 continuously writes external sounds collected by a microphone into a ring buffer. This hearing aid apparatus reads out, among the external sound data stored in the ring buffer, external sound data corresponding to a prescribed period of time and analyzes the read-out external sound data to determine the presence of a voice. If the result of an immediately preceding determination indicates that no voice is present, the hearing aid apparatus reads out the external sound data that has just been written into the ring buffer, amplifies the read-out external sound data at an amplification factor for environmental sounds, and outputs the result through a speaker. If the result of an immediately preceding determination indicates that no voice is present but the result of a current determination indicates that a voice is present, the hearing aid apparatus reads out, from the ring buffer, the external sound data corresponding to the period in which it has been determined that a voice is present, amplifies the read-out external sound data at an amplification factor for a voice while time-compressing the data, and outputs the result through the speaker.

A speech rate conversion apparatus disclosed in Japanese Unexamined Patent Application Publication No. 2005-148434 separates an input audio signal into a voice segment and a no-sound-and-no-voice segment and carries out signal processing of temporally extending the voice segment into the no-sound-and-no-voice segment to thus output a signal that has its rate of speech converted. The speech rate conversion apparatus detects, from the input audio signal, a forecast-sound signal in a time signal formed of the forecast-sound signal and a correct-alarm-sound signal. When the speech rate conversion apparatus detects the forecast-sound signal, the speech rate conversion apparatus deletes the time signal from the voice segment that has been subjected to the signal processing. In addition, when the speech rate conversion apparatus detects the forecast-sound signal, the speech rate conversion apparatus newly generates a time signal formed of the forecast-sound signal and the correct-alarm-sound signal. The speech rate conversion apparatus then combines the newly generated time signal with an output signal such that the output timing of the correct-alarm sound in the stated time signal coincides with an output timing in a case in which the correct-alarm sound in the time signal of the input audio signal is to be output.

A binaural hearing aid system disclosed in Japanese Unexamined Patent Application Publication (Translation of PCT Application) No. 2009-528802 includes a first microphone system for the provision of a first input signal, the first microphone system is adapted to be placed in or at a first ear of a user; and a second microphone system for the provision of a second input signal, the second microphone system is adapted to be placed in or at a second ear of the user. The binaural hearing aid system automatically switches between an omnidirectional (OMNI) microphone mode and a directional (DIR) microphone mode.

The above-described conventional techniques require further improvements.

SUMMARY

In one general aspect, the techniques disclosed here feature an audio processing apparatus that includes an acquirer that acquires a surrounding audio signal indicating a sound surrounding a user; an audio extractor that extracts, from the acquired surrounding audio signal, a providing audio signal indicating a sound to be provided to the user; and an output that outputs a first audio signal indicating a main sound and the providing audio signal.

It is to be noted that general or specific embodiments of such may be implemented in the form of a system, a method, an integrated circuit, a computer program, or a recording medium, or through any desired combination of a system, an apparatus, a method, an integrated circuit, a computer program, and a recording medium.

According to the present disclosure, among sounds surrounding a user a sound to be provided to the user can be output.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Figure 1:
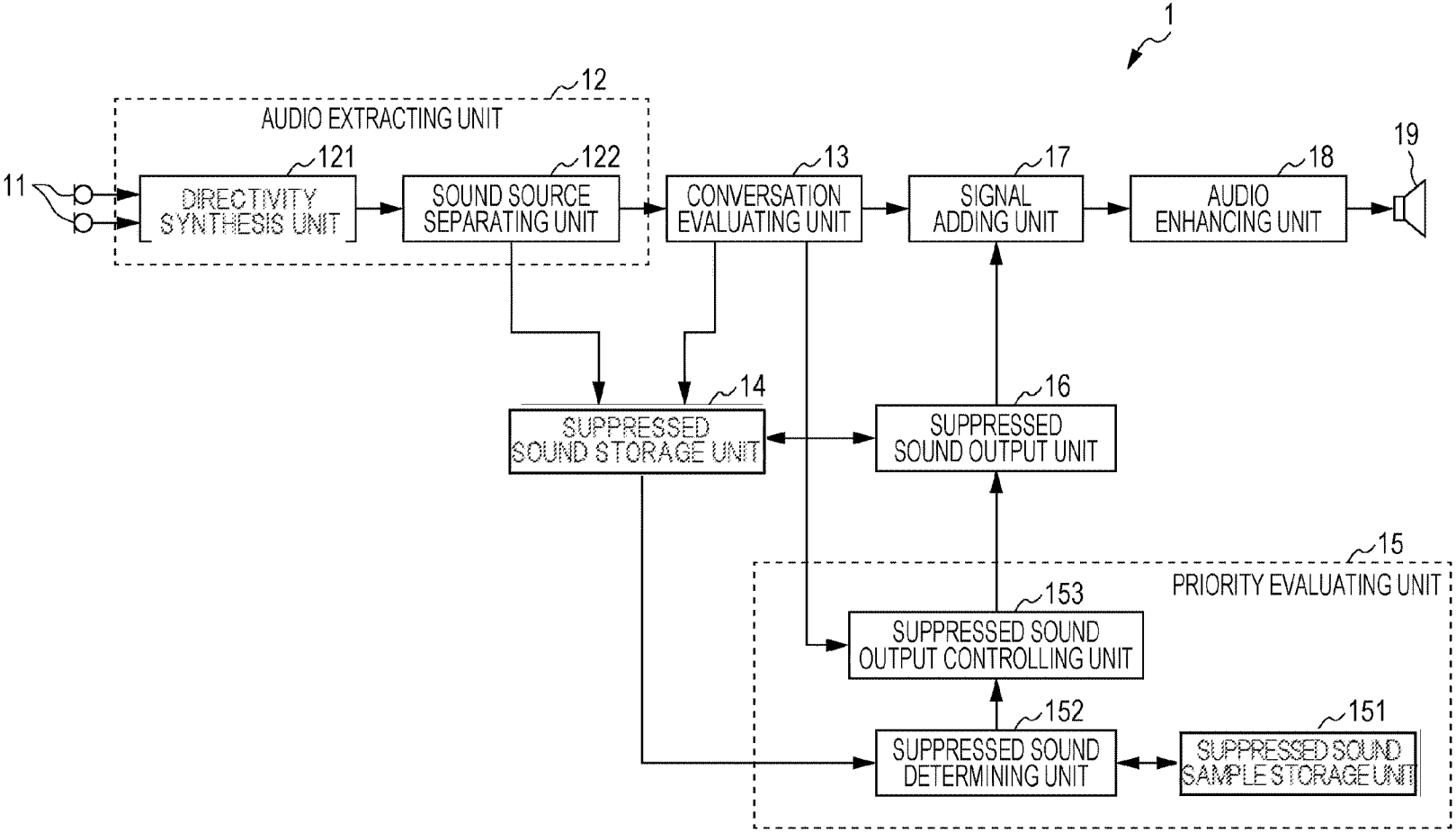
FIG. 1 illustrates a configuration of an audio processing apparatus according to a first embodiment.

Underlying Knowledge Forming Basis of the Present Disclosure

According to the conventional techniques, as the sounds other than the voice of the conversing party are suppressed, some sounds surrounding the user, including a telephone ring tone, for example, become complete inaudible to the user. Therefore, the user may not hear the telephone ring tone and may miss a call.

With the technique disclosed in Japanese Unexamined Patent Application Publication No. 2005-64744, the presence of a voice is determined, and the amplification factor is set higher when it is determined that a voice is present than when it is determined that no voice is present. Thus, when a conversation is taking place in a noisy environment, the noise is output at high volume as well, which may make the conversation less intelligible.

With the technique disclosed in Japanese Unexamined Patent Application Publication No. 2005-148434, even when the rate of speech of an input audio signal is converted, the sound of a time signal is output concurrently or with little delay. However, environmental sounds other than voices and the time signal are not suppressed, which may make a conversion less intelligible.

Japanese Unexamined Patent Application Publication (Translation of PCT Application) No. 2009-528802 indicates that the omnidirectional microphone mode and the directional microphone mode of the microphone for acquiring sounds are switched therebetween automatically, but does not indicate that the sounds, among the acquired sounds, that are not necessary for the user are suppressed or sounds that are necessary for the user are extracted from the acquired sounds.

In light of the above considerations, the present inventors have conceived of the embodiments of the present disclosure.

An audio processing apparatus according to an aspect of the present disclosure includes an acquirer that acquires a surrounding audio signal indicating a sound surrounding a user; an audio extractor that extracts, from the acquired surrounding audio signal, a providing audio signal indicating a sound to be provided to the user; and an output that outputs a first audio signal indicating a main sound and the providing audio signal.

According to this configuration, a surrounding audio signal indicating a sound surrounding the user is acquired; a providing audio signal indicating a sound to be provided to the user is extracted from the acquired surrounding audio signal; and a first audio signal indicating a main sound and the providing audio signal are output.

Accordingly, among the sounds surrounding the user, a sound to be provided to the user can be output.

The above-described audio processing apparatus may further include an audio separator that separates the acquired surrounding audio signal into the first audio signal and a second audio signal indicating a sound different from the main sound. The audio extractor may extract the providing audio signal from the separated second audio signal. The output may output the separated first audio signal and may also output the extracted providing audio signal extracted by the audio extractor.

According to this configuration, the acquired surrounding audio signal is separated into the first audio signal and a second audio signal indicating a sound different from the main sound. The providing audio signal is extracted from the separated second audio signal. The separated first audio signal is output, and the extracted providing audio signal is output.

Accordingly, sounds surrounding the user are separated into the main sound and a sound different from the main sound. The sound different from the main sound is suppressed, and thus the user can more clearly hear the main sound.

In the above-described audio processing apparatus, the main sound may include a sound uttered by a person participating in a conversation.

According to this configuration, a sound different from a sound uttered by a person participating in a conversation is suppressed, and thus the user can more clearly hear the sound uttered by the person participating in the conversation.

The above-described audio processing apparatus may further include an audio signal storage that stores the first audio signal in advance. The output may output the first audio signal read out from the audio signal storage and may also output the extracted providing audio signal.

According to this configuration, the first audio signal is stored in the audio signal storage in advance, the first audio signal read out from the audio signal storage is output, and the extracted providing audio signal is output. Thus, the main sound stored in advance can be output, instead of the main sound being separated from the sounds surrounding the user.

In the above-described audio processing apparatus, the main sound may include music data. According to this configuration, the music data can be output.

The above-described audio processing apparatus may further include a sample sound storage that stores a sample audio signal related to the providing audio signal. The audio extractor may compare a feature amount of the surrounding audio signal with a feature amount of the sample audio signal recorded in the sample sound storage and extract an audio signal having a feature amount similar to the feature amount of the sample audio signal as the providing audio signal.

According to this configuration, a sample audio signal related to the providing audio signal is stored in the sample sound storage. The feature amount of the surrounding audio signal is compared with the feature amount of the sample audio signal recorded in the sample sound storage, and an audio signal having a feature amount similar to the feature amount of the sample audio signal is extracted as the providing audio signal.

Accordingly, the providing audio signal can be extracted with ease by comparing the feature amount of the surrounding audio signal with the feature amount of the sample audio signal recorded in the sample sound storage.

The above-described audio processing apparatus may further include a selector that selects any one of (i) a first output pattern in which the providing audio signal is output along with the first audio signal without a delay, (ii) a second output pattern in which the providing audio signal is output with a delay after only the first audio signal is output, and (iii) a third output pattern in which only the first audio signal is output in a case in which the providing audio signal is not extracted from the surrounding audio signal; and an audio output that outputs (i) the providing audio signal along with the first audio signal without a delay in a case in which the first output pattern is selected, (ii) the providing audio signal with a delay after only the first audio signal is output in a case in which the second output pattern is selected, or (iii) only the first audio signal in a case in which the third output pattern is selected.

According to this configuration, any one of the first output pattern in which the providing audio signal is output along with the first audio signal without a delay, the second output pattern in which the providing audio signal is output with a delay after only the first audio signal is output, and the third output pattern in which only the first audio signal is output in a case in which the providing audio signal is not extracted from the surrounding audio signal is selected. When the first output pattern is selected, the providing audio signal is output along with the first audio signal without a delay. When the second output pattern is selected, the providing audio signal is output with a delay after only the first audio signal is output. When the third output pattern is selected, only the first audio signal is output.

Accordingly, the timing at which the providing audio signal is output can be determined in accordance with the priority of the providing audio signal. A providing audio signal that is more urgent can be output along with the first audio signal, whereas a providing audio signal that is less urgent can be output after the first audio signal is output. A surrounding audio signal that does not need to be provided to the user in particular can be suppressed without being output.

The above-described audio processing apparatus may further include a no-voice segment detector that detects a no-voice segment extending from a point at which an output of the first audio signal finishes to a point at which a subsequent first audio signal is input. When the second output pattern is selected, the audio output may determine whether the no-voice segment has been detected by the no-voice segment detector. If it is determined that the no-voice segment has been detected, the audio output may output the providing audio signal with the delay in the no-voice segment.

According to this configuration, a no-voice segment extending from a point at which an output of the first audio signal finishes to a point at which a subsequent first audio signal is input is detected. When the second output pattern is selected, it is determined whether the no-voice segment has been detected by the no-voice segment detector. If it is determined that the no-voice segment has been detected, the delayed providing audio signal is output in the no-voice segment.

Accordingly, the delayed providing audio signal is output in the no-voice segment in which a person's utterance is not present, and thus the user can more clearly hear the delayed providing audio signal.

The above-described audio processing apparatus may further include a speech rate detector that detects a rate of speech in the first audio signal. When the second output pattern is selected, the audio output may determine whether the detected rate of speech is lower than a predetermined rate. If it is determined that the rate of speech is lower than the predetermined rate, the audio output may output the providing audio signal with the delay.

According to this configuration, the rate of speech in the first audio signal is detected. When the second output pattern is selected, it is determined whether the detected rate of speech is lower than a predetermined rate. If it is determined that the rate of speech is lower than the predetermined rate, the delayed providing audio signal is output.

Accordingly, the delayed providing audio signal is output when the rate of speech falls below the predetermined rate, and thus the user can more clearly hear the delayed providing audio signal.

The above-described audio processing apparatus may further include a no-voice segment detector that detects a no-voice segment extending from a point at which an output of the first audio signal finishes to a point at which a subsequent first audio signal is input. When the second output pattern is selected, the audio output may determine whether the detected no-voice segment extends for or longer than a predetermined duration. If it is determined that the no-voice segment extends for or longer than the predetermined duration, the audio output may output the providing audio signal with the delay in the no-voice segment.

According to this configuration, a no-voice segment extending from a point at which an output of the first audio signal finishes to a point at which a subsequent first audio signal is input is detected. When the second output pattern is selected, it is determined whether the detected no-voice segment extends for or longer than a predetermined duration. If it is determined that the no-voice segment extends for or longer than the predetermined duration, the delayed providing audio signal is output in the no-voice segment.

Accordingly, the delayed providing audio signal is output when utterances diminish, and thus the user can more clearly hear the delayed providing audio signal.

An audio processing method according to another aspect of the present disclosure includes acquiring a surrounding audio signal indicating a sound surrounding a user; extracting, from the acquired surrounding audio signal, a providing audio signal indicating a sound to be provided to the user; and outputting a first audio signal indicating a main sound and the providing audio signal.

According to this configuration, a surrounding audio signal indicating a sound surrounding the user is acquired, a providing audio signal indicating a sound to be provided to the user is extracted from the acquired surrounding audio signal, and a first audio signal indicating a main sound and the providing audio signal are output.

Accordingly, among the sounds surrounding the user, a sound to be provided to the user can be output.

A non-transitory recording medium according to another aspect of the present disclosure has a program recorded thereon. The program causes a computer of an audio processing apparatus to perform a method includes acquiring a surrounding audio signal indicating a sound surrounding a user; extracting, from the acquired surrounding audio signal, a providing audio signal indicating a sound to be provided to the user; and outputting a first audio signal indicating a main sound and the providing audio signal.

According to this configuration, a surrounding audio signal indicating a sound surrounding the user is acquired, a providing audio signal indicating a sound to be provided to the user is extracted from the acquired surrounding audio signal, and a first audio signal indicating a main sound and the providing audio signal are output.

Accordingly, among the sounds surrounding the user, a sound to be provided to the user can be output.

Hereinafter, embodiments of the present disclosure will be described with reference to the accompanying drawings. It is to be noted that the following embodiments are examples that embody the present disclosure and are not intended to limit the technical scope of the present disclosure.

First Embodiment

FIG. 1 illustrates a configuration of an audio processing apparatus according to a first embodiment. An audio processing apparatus 1 is, for example, a hearing aid.

The audio processing apparatus 1 illustrated in FIG. 1 includes a microphone array 11, an audio extracting unit 12, a conversation evaluating unit 13, a suppressed sound storage unit 14, a priority evaluating unit 15, a suppressed sound output unit 16, a signal adding unit 17, an audio enhancing unit 18, and a speaker 19.

The microphone array 11 is constituted by a plurality of microphones. Each of microphones collects a surrounding sound and converts the collected sound to an audio signal.

The audio extracting unit 12 extracts audio signals in accordance with their sound sources. The audio extracting unit 12 acquires a surrounding audio signal indicating a sound surrounding a user. The audio extracting unit 12 extracts a plurality of audio signals corresponding to different sound sources on the basis of the plurality of audio signals acquired by the microphone array 11. The audio extracting unit 12 includes a directivity synthesis unit 121 and a sound source separating unit 122.

The directivity synthesis unit 121 extracts, from the plurality of audio signals output from the microphone array 11, a plurality of audio signals output from the same sound source.

The sound source separating unit 122 separates the plurality of input audio signals into an uttered audio signal that corresponds to a sound uttered by a person and that indicates a main sound and a suppressed audio signal that corresponds to a sound other than an utterance and is different from the main sound and that indicates a sound to be suppressed, through blind sound source separation processing, for example. The main sound includes a sound uttered by a person participating in a conversation. The sound source separating unit 122 separates the audio signals in accordance with their sound sources. For example, when a plurality of speakers are talking, the sound source separating unit 122 separates the audio signals corresponding to the respective speakers. The sound source separating unit 122 outputs a separated uttered audio signal to the conversation evaluating unit 13 and outputs a separated suppressed audio signal to the suppressed sound storage unit 14.

The conversation evaluating unit 13 evaluates a plurality of uttered audio signals input from the sound source separating unit 122. Specifically, the conversation evaluating unit 13 identifies the speakers of the respective uttered audio signals. For example, the conversation evaluating unit 13 stores the speakers and the acoustic parameters associated with the speakers, which are to be used to identify the speakers. The conversation evaluating unit 13 identifies the speakers corresponding to the respective uttered audio signals by comparing the input uttered audio signals with the stored acoustic parameters. The conversation evaluating unit 13 may identify the speakers on the basis of the magnitude (level) of the input uttered audio signals. Specifically, the voice of the user using the audio processing apparatus 1 is greater than the voice of a conversing party. Thus, the conversation evaluating unit 13 may determine that an input uttered audio signal corresponds to the user's utterance if the level of that uttered audio signal is no less than a predetermined value, or determine that an input uttered audio signal corresponds to an utterance of a person other than the user if the level of that uttered audio signal is less than the predetermined value. In addition, the conversation evaluating unit 13 may determine that an uttered audio signal of the second greatest level is an uttered audio signal indicating the voice of the party with whom the user is conversing.

In addition, the conversation evaluating unit 13 identifies utterance segments of the respective uttered audio signals. The conversation evaluating unit 13 may detect a no-voice segment extending from a point at which an output of an uttered audio signal finishes to a point at which a subsequent uttered audio signal is input. A no-voice segment is a segment in which no conversation takes place. Thus, the conversation evaluating unit 13 does not detect a given segment as a no-voice segment if a sound other than a conversion is present in that segment.

Furthermore, the conversation evaluating unit 13 may calculate the rate of speech (the rate of utterance) of the plurality of uttered audio signals. For example, the conversation evaluating unit 13 may calculate the rate of speech by dividing the number of characters uttered within a predetermined period of time by the predetermined period of time.

The suppressed sound storage unit 14 stores a plurality of suppressed audio signals input from the sound source separating unit 122. The conversation evaluating unit 13 may output, to the suppressed sound storage unit 14, an uttered audio signal indicating a sound uttered by the user and an uttered audio signal indicating a sound uttered by a person other than the party with whom the user is conversing. The suppressed sound storage unit 14 may store an uttered audio signal indicating a sound uttered by the user and an uttered audio signal indicating a sound uttered by a person other than the party with whom the user is conversing.

The priority evaluating unit 15 evaluates the priority of a plurality of suppressed audio signals. The priority evaluating unit 15 includes a suppressed sound sample storage unit 151, a suppressed sound determining unit 152, and a suppressed sound output controlling unit 153.

The suppressed sound sample storage unit 151 stores acoustic parameters indicating feature amounts of suppressed audio signals to be provided to the user for the respective suppressed audio signals. In addition, the suppressed sound sample storage unit 151 may store the priority associated with the acoustic parameters. A sound that is highly important (urgent) is given a high priority, whereas a sound that is not very important (urgent) is given a low priority. For example, a sound that should be provided to the user immediately even when the user is in the middle of a conversation is given a first priority, whereas a sound that can wait until the user finishes a conversation is given a second priority, which is lower than the first priority. In addition, a sound that does not need to be provided to the user may be given a third priority, which is lower than the second priority. The suppressed sound sample storage unit 151 does not need to store an acoustic parameter of a sound that does not need to be provided to the user.

Examples of sounds to be provided to the user include a telephone ring tone, a new mail alert sound, an intercom sound, a vehicle engine sound (sound of a vehicle approaching), a vehicle horn sound, and notification sounds of home appliances, such as a notification sound notifying that the laundry has finished. These sounds to be provided to the user include a sound to which the user needs to respond immediately and a sound to which the user does not need to respond immediately but needs to respond at a later time.

The suppressed sound determining unit 152 determines, among the plurality of suppressed audio signals stored in the suppressed sound storage unit 14, a suppressed audio signal (providing audio signal) indicating a sound to be provided to the user. The suppressed sound determining unit 152 extracts a suppressed audio signal indicating a sound to be provided to the user from the acquired surrounding audio signals (suppressed audio signals). The suppressed sound determining unit 152 compares the acoustic parameters of the plurality of suppressed audio signals stored in the suppressed sound storage unit 14 with the acoustic parameters stored in the suppressed sound sample storage unit 151, and extracts, from the suppressed sound storage unit 14, a suppressed audio signal having an acoustic parameter similar to an acoustic parameter stored in the suppressed sound sample storage unit 151.

The suppressed sound output controlling unit 153 determines whether the suppressed audio signal that the suppressed sound determining unit 152 has determined to be a suppressed audio signal indicating a sound to be provided to the user is to be output on the basis of the priority given to that suppressed audio signal, and also determines the timing at which the suppressed audio signal is to be output. The suppressed sound output controlling unit 153 selects any one of a first output pattern in which a suppressed audio signal is output along with an uttered audio signal without a delay, a second output pattern in which a suppressed audio signal is output with a delay after only an uttered audio signal is output, and a third output pattern in which only an uttered audio signal is output in a case in which no suppressed audio signal has been extracted.

Figure 2:
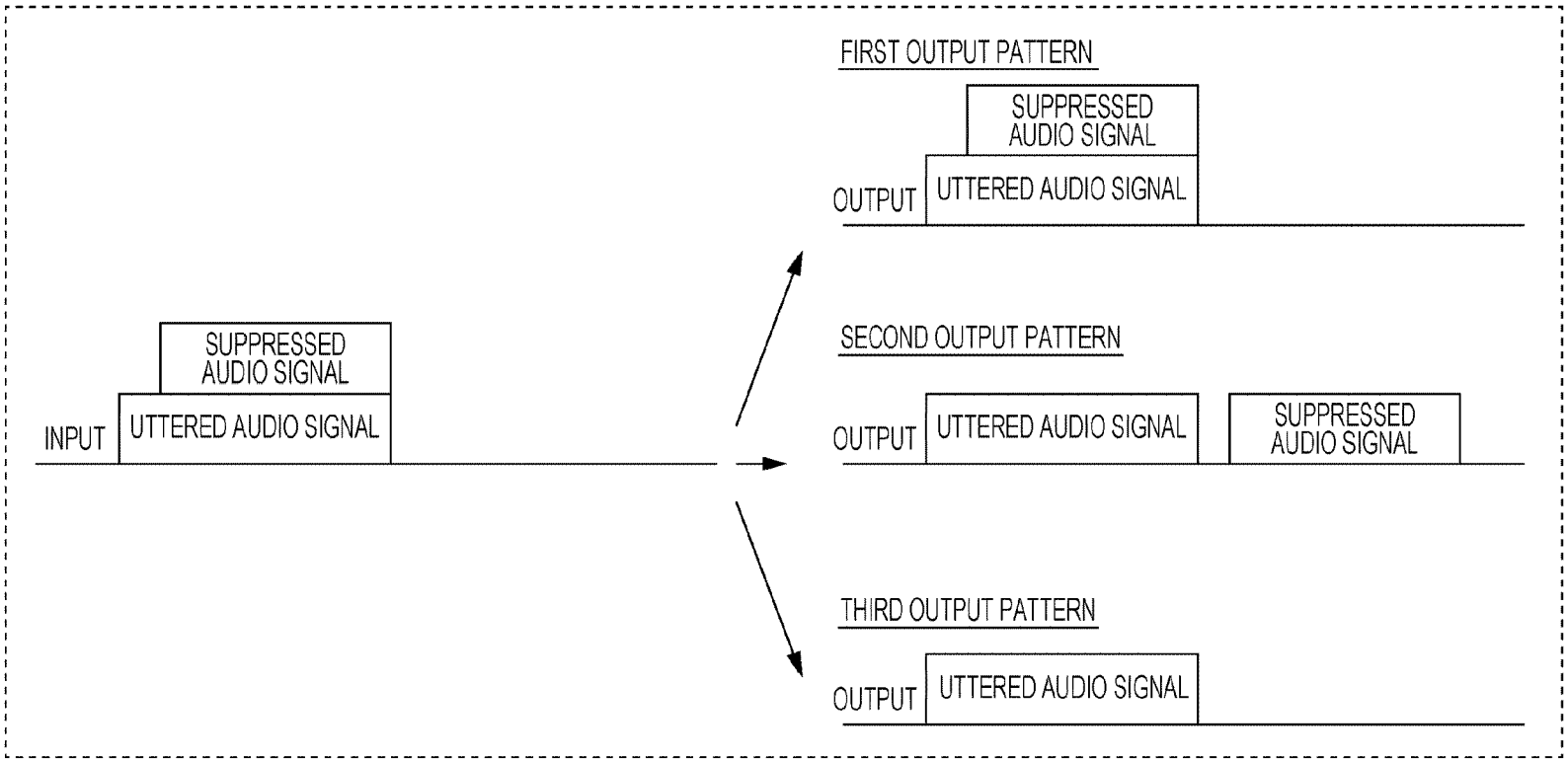
FIG. 2 illustrates exemplary output patterns according to the first embodiment.

FIG. 2 illustrates exemplary output patterns according to the first embodiment. The suppressed sound output controlling unit 153 selects the first output pattern in which a suppressed audio signal is output along with an uttered audio signal without a delay if the suppressed audio signal is given the first priority. Meanwhile, the suppressed sound output controlling unit 153 selects the second output pattern in which a suppressed audio signal is output with a delay after only an uttered audio signal is output if the suppressed audio signal is given the second priority, which is lower than the first priority. The suppressed sound output controlling unit 153 selects the third output pattern in which only an uttered audio signal is output if no suppressed audio signal to be provided to the user has been extracted.

When the first output pattern is selected, the suppressed sound output controlling unit 153 instructs the suppressed sound output unit 16 to output a suppressed audio signal. Meanwhile, when the second output pattern is selected, the suppressed sound output controlling unit 153 determines whether the conversation evaluating unit 13 has detected a no-voice segment. If it is determined that a no-voice segment has been detected, the suppressed sound output controlling unit 153 instructs the suppressed sound output unit 16 to output a suppressed audio signal. When the third output pattern is selected, the suppressed sound output controlling unit 153 instructs the suppressed sound output unit 16 not to output a suppressed audio signal.

The suppressed sound output controlling unit 153 may determine whether a suppressed audio signal to be provided to the user has been input so as to temporally overlap an uttered audio signal. If it is determined that a suppressed audio signal to be provided to the user has been input so as to temporally overlap an uttered audio signal, the suppressed sound output controlling unit 153 may select any one of the first to third output patterns. Meanwhile, if it is determined that a suppressed audio signal to be provided to the user has been input so as not to temporally overlap an uttered audio signal, the suppressed sound output controlling unit 153 may output the input suppressed audio signal.

When the second output pattern is selected, the suppressed sound output controlling unit 153 may determine whether a no-voice segment detected by the conversation evaluating unit 13 extends for or longer than a predetermined duration. If it is determined that the no-voice segment extends for or longer than the predetermined duration, the suppressed sound output controlling unit 153 may instruct the suppressed sound output unit 16 to output a suppressed audio signal.

Furthermore, when the second output pattern is selected, the suppressed sound output controlling unit 153 may determine whether the rate of speech detected by the conversation evaluating unit 13 is lower than a predetermined rate. If it is determined that the rate of speech is lower than the predetermined rate, the suppressed sound output controlling unit 153 may instruct the suppressed sound output unit 16 to output a suppressed audio signal.

The suppressed sound output unit 16 outputs a suppressed audio signal in response to an instruction from the suppressed sound output controlling unit 153.

The signal adding unit 17 outputs an uttered audio signal (first audio signal) indicating a main sound and a suppressed audio signal (providing audio signal) to be provided to the user. The signal adding unit 17 combines (adds) a separated uttered audio signal output by the conversation evaluating unit 13 with a suppressed audio signal output by the suppressed sound output unit 16 and outputs the result. When the first output pattern is selected, the signal adding unit 17 outputs the suppressed audio signal along with the uttered audio signal without a delay. When the second output pattern is selected, the signal adding unit 17 outputs the suppressed audio signal with a delay after only the uttered audio signal is output. When the third output pattern is selected, the signal adding unit 17 outputs only the uttered audio signal.

The audio enhancing unit 18 enhances an uttered audio signal and/or a suppressed audio signal output by the signal adding unit 17. The audio enhancing unit 18 enhances an audio signal in order to match the audio signal to the hearing characteristics of the user by, for example, amplifying the audio signal or adjusting the amplification factor of the audio signal in each frequency band. Enhancing an uttered audio signal and/or a suppressed audio signal makes an uttered sound and/or a suppressed sound more audible to a person with a hearing impairment.

The speaker 19 converts an uttered audio signal and/or a suppressed audio signal enhanced by the audio enhancing unit 18 into an uttered sound and/or a suppressed sound, and outputs the converted uttered sound and/or suppressed sound. The speaker 19 is, for example, an earphone.

The audio processing apparatus 1 according to the first embodiment does not have to include the microphone array 11, the audio enhancing unit 18, and the speaker 19. For example, a hearing aid that the user wears may include the microphone array 11, the audio enhancing unit 18, and the speaker 19; and the hearing aid may be communicably connected to the audio processing apparatus 1 through a network.

Figure 3:
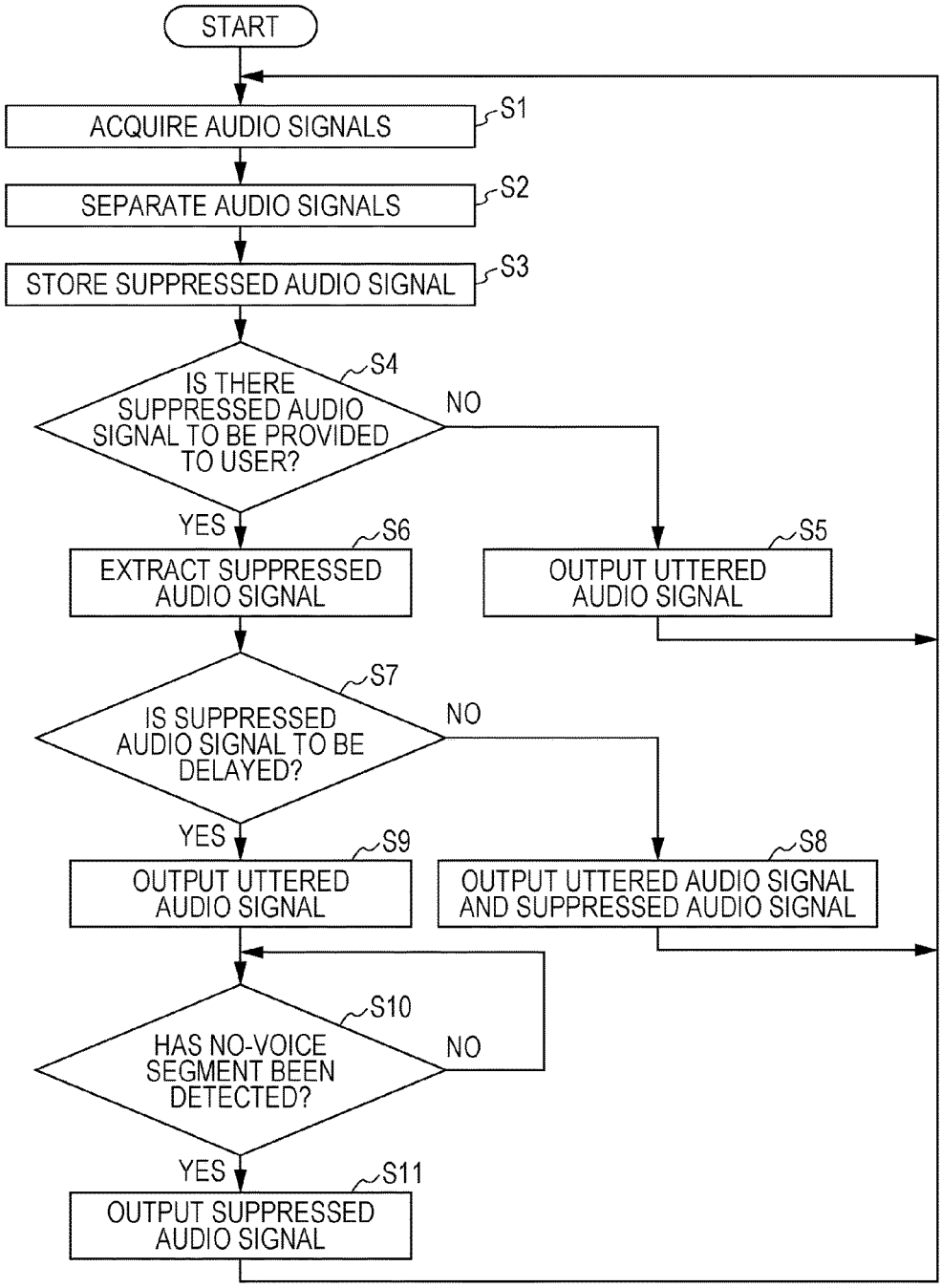
FIG. 3 is a flowchart for describing an exemplary operation of the audio processing apparatus according to the first embodiment.

FIG. 3 is a flowchart for describing an exemplary operation of the audio processing apparatus according to the first embodiment.

In step S1, the directivity synthesis unit 121 acquires audio signals converted by the microphone array 11.

In step S2, the sound source separating unit 122 separates the acquired audio signals in accordance with their sound sources. In particular, of the audio signals separated in accordance with their sound sources, the sound source separating unit 122 outputs an uttered audio signal indicating an audio signal of a person's utterance to the conversation evaluating unit 13 and outputs a suppressed audio signal indicating an audio signal to be suppressed other than an uttered audio signal to the suppressed sound storage unit 14.

In step S3, the sound source separating unit 122 stores the separated suppressed audio signal into the suppressed sound storage unit 14.

In step S4, the suppressed sound determining unit 152 determines whether a suppressed audio signal to be provided to the user is present in the suppressed sound storage unit 14. The suppressed sound determining unit 152 compares the feature amount of an extracted suppressed audio signal with the feature amounts of the samples of the suppressed audio signals stored in the suppressed sound sample storage unit 151. If a suppressed audio signal having a feature amount similar to the feature amount of a sample of the suppressed audio signals stored in the suppressed sound sample storage unit 151 is present, the suppressed sound determining unit 152 determines that a suppressed audio signal to be provided to the user is present in the suppressed sound storage unit 14.

If it is determined that no suppressed audio signal to be provided to the user is present in the suppressed sound storage unit 14 (NO in step S4), in step S5, the signal adding unit 17 outputs only an uttered audio signal output from the conversation evaluating unit 13. The audio enhancing unit 18 enhances the uttered audio signal output by the signal adding unit 17. Then, the speaker 19 converts the uttered audio signal enhanced by the audio enhancing unit 18 into an uttered sound, and outputs the converted uttered sound. In this case, sounds other than the utterance are suppressed and are thus not output. After the uttered sound is output, the processing returns to the process in step S1.

Meanwhile, if it is determined that a suppressed audio signal to be provided to the user is present in the suppressed sound storage unit 14 (YES in step S4), in step S6, the suppressed sound determining unit 152 extracts the suppressed audio signal to be provided to the user from the suppressed sound storage unit 14.

In step S7, the suppressed sound output controlling unit 153 determines whether the suppressed audio signal to be provided to the user, which has been extracted by the suppressed sound determining unit 152, is to be delayed on the basis of the priority given to that suppressed audio signal. For example, the suppressed sound output controlling unit 153 determines that the suppressed audio signal to be provided to the user is not to be delayed if the priority given to that suppressed audio signal, which has been determined to be the suppressed audio signal to be provided to the user, is no less than a predetermined value. In addition, the suppressed sound output controlling unit 153 determines that the suppressed audio signal to be provided to the user is to be delayed if the priority given to that suppressed audio signal, which has been determined to be the suppressed audio signal to be provided to the user, is less than the predetermined value.

If it is determined that the suppressed audio signal to be provided to the user is not to be delayed, the suppressed sound output controlling unit 153 instructs the suppressed sound output unit 16 to output the suppressed audio signal to be provided to the user that has been extracted in step S6. The suppressed sound output unit 16 outputs the suppressed audio signal to be provided to the user in response to the instruction from the suppressed sound output controlling unit 153.

If it is determined that the suppressed audio signal to be provided to the user is not to be delayed (NO in step S7), in step S8, the signal adding unit 17 outputs the uttered audio signal output from the conversation evaluating unit 13 and the suppressed audio signal to be provided to the user output from the suppressed sound output unit 16. The audio enhancing unit 18 enhances the uttered audio signal and the suppressed audio signal, which have been output by the signal adding unit 17. The speaker 19 then converts the uttered audio signal and the suppressed audio signal, which have been enhanced by the audio enhancing unit 18, into an uttered sound and a suppressed sound, respectively, and outputs the converted uttered sound and suppressed sound. In this case, sounds other than the utterance are output so as to overlap the utterance. After the uttered sound and the suppressed sound are output, the processing returns to the process in step S1.

Meanwhile, if it is determined that the suppressed audio signal to be provided to the user is to be delayed (YES in step S7), in step S9, the signal adding unit 17 outputs only the uttered audio signal output from the conversation evaluating unit 13. The audio enhancing unit 18 enhances the uttered audio signal output by the signal adding unit 17. Then, the speaker 19 converts the uttered audio signal enhanced by the audio enhancing unit 18 into an uttered sound, and outputs the converted uttered sound.

In step S10, the suppressed sound output controlling unit 153 determines whether a no-voice segment, in which the user's conversation is not detected, has been detected. The conversation evaluating unit 13 detects a no-voice segment extending from a point at which an output of an uttered audio signal finishes to a point at which a subsequent uttered audio signal is input. If a no-voice segment is detected, the conversation evaluating unit 13 notifies the suppressed sound output controlling unit 153. When the suppressed sound output controlling unit 153 is notified by the conversation evaluating unit 13 that a no-voice segment has been detected, the suppressed sound output controlling unit 153 determines that a no-voice segment has been detected. If it is determined that a no-voice segment has been detected, the suppressed sound output controlling unit 153 instructs the suppressed sound output unit 16 to output the suppressed audio signal to be provided to the user that has been extracted in step S6 in the no-voice segment. The suppressed sound output unit 16 outputs the suppressed audio signal to be provided to the user in response to the instruction from the suppressed sound output controlling unit 153. If it is determined that no no-voice segment has been detected (NO in step S10), the process in step S10 is repeated until a no-voice segment is detected.

Meanwhile, if it is determined that a no-voice segment has been detected (YES in step S10), in step S11, the signal adding unit 17 outputs the suppressed audio signal to be provided to the user output by the suppressed sound output unit 16. The audio enhancing unit 18 enhances the suppressed audio signal output by the signal adding unit 17. Then, the speaker 19 converts the suppressed audio signal enhanced by the audio enhancing unit 18 into a suppressed sound, and outputs the converted suppressed sound. After the suppressed sound is output, the processing returns to the process in step S1.

Now, modifications to the timing at which a suppressed audio signal to be provided to the user is output with a delay will be described.

Figure 4:
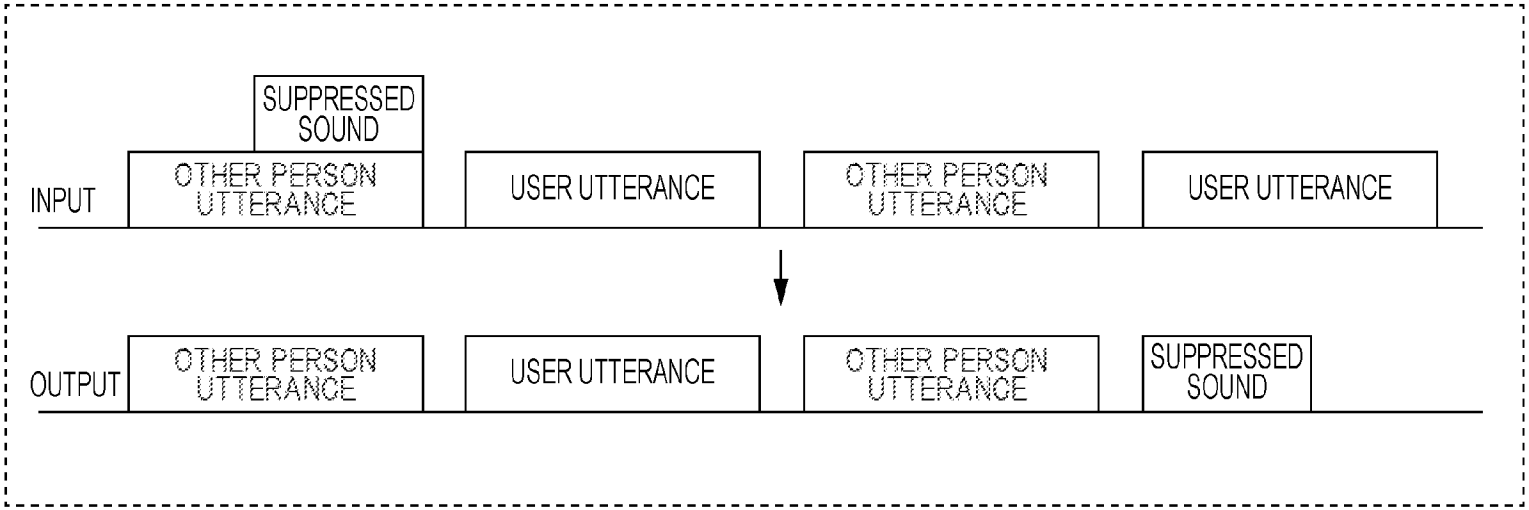
FIG. 4 is a schematic diagram for describing a first modification of a timing at which a suppressed audio signal to be provided to a user is output with a delay.

FIG. 4 is a schematic diagram for describing a first modification of the timing at which a suppressed audio signal to be provided to the user is output with a delay.

The user can control his or her own utterance, and thus a problem does not arise even if a suppressed sound is output so as to overlap the user's utterance. Therefore, the suppressed sound output controlling unit 153 may predict a timing at which an uttered audio signal of the user's utterance is output and instruct the suppressed sound output unit 16 to output a suppressed sound to be provided to the user at the predicted timing.

As illustrated in FIG. 4, in a case in which the user's utterance and the other person's utterance are input in an alternating manner, if a no-voice segment is detected after the other person's utterance, it can be predicted that the user's utterance will be input next. Therefore, the conversation evaluating unit 13 identifies the speaker of an input uttered audio signal and notifies the suppressed sound output controlling unit 153. In a case in which, after a suppressed audio signal corresponding to a suppressed sound to be provided to the user is input so as to overlap an uttered audio signal corresponding to the other person's utterance, an uttered audio signal corresponding to the user's utterance and an uttered audio signal corresponding to the other person's utterance are input in an alternatively manner and a no-voice segment is detected after the uttered audio signal corresponding to the other person's utterance, the suppressed sound output controlling unit 153 instructs the suppressed sound output unit 16 to output the suppressed sound to be provided to the user.

Through this configuration, the suppressed sound to be provided to the user is out at a timing at which the user speaks, and thus the user can more certainly hear the suppressed sound to be provided to the user.

Alternatively, in a case in which, after a suppressed audio signal corresponding to a suppressed sound to be provided to the user is input so as to overlap an uttered audio signal corresponding to the other person's utterance, an uttered audio signal corresponding to the user's utterance is input, the suppressed sound output controlling unit 153 may instruct the suppressed sound output unit 16 to output the suppressed sound to be provided to the user.

As another alternative, in a case in which the amount of conversation has decreased and an interval between utterances has increased, the suppressed sound output controlling unit 153 may instruct the suppressed sound output unit 16 to output a suppressed sound to be provided to the user.

Figure 5:
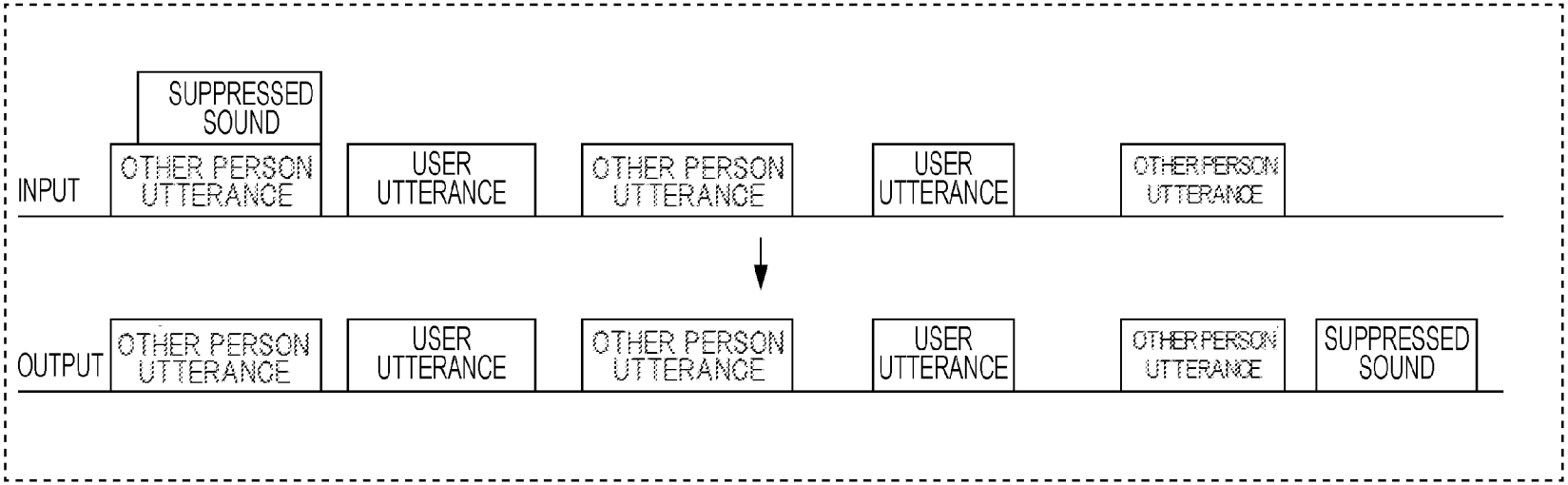
FIG. 5 is a schematic diagram for describing a second modification of a timing at which a suppressed audio signal to be provided to a user is output with a delay.

FIG. 5 is a schematic diagram for describing a second modification of the timing at which a suppressed audio signal to be provided to the user is output with a delay.

When the amount of conversation has decreased and the interval between utterances has increased, even if a suppressed sound to be provided to the user is output in a no-voice segment, it is highly unlikely that the suppressed sound to be provided to the user overlaps an utterance. Therefore, the suppressed sound output controlling unit 153 may store no-voice segments detected by the conversation evaluating unit 13 and instruct the suppressed sound output unit 16 to output a suppressed sound to be provided to the user when a detected no-voice segment continuously extends longer than a previously detected no-voice segment for a predetermined number of times.

As illustrated in FIG. 5, when a no-voice segment between utterances extends longer and longer, it can be determined that the amount of conversation has decreased. Therefore, the conversation evaluating unit 13 detects a no-voice segment extending from a point at which an output of an uttered audio signal finishes to a point at which a subsequent uttered audio signal is input. The suppressed sound output controlling unit 153 stores the length of a no-voice segment detected by the conversation evaluating unit 13. When a detected no-voice segment continuously extends longer than a previously detected no-voice segment for a predetermined number of times, the suppressed sound output controlling unit 153 instructs the suppressed sound output unit 16 to output a suppressed sound to be provided to the user. In the example illustrated in FIG. 5, the suppressed sound output controlling unit 153 instructs the suppressed sound output unit 16 to output a suppressed sound to be provided to the user when a detected no-voice segment continuously extends longer than a previously detected no-voice segment three times.

Through this configuration, a suppressed sound to be provided to the user is output at a timing at which the amount of conversation has decreased, and thus the user can more certainly hear the suppressed sound to be provided to the user.

The audio processing apparatus 1 may further include an uttered sound storage unit that, in a case in which the suppressed sound output controlling unit 153 has determined that a suppressed audio signal to be provided to the user is given the highest priority, or in other words, the suppressed audio signal to be provided to the user is a sound that should be provided to the user immediately, stores an uttered audio signal separated by the sound source separating unit 122. If the suppressed sound output controlling unit 153 determines that a suppressed audio signal to be provided to the user is given the highest priority, the suppressed sound output controlling unit 153 instructs the suppressed sound output unit 16 to output the suppressed audio signal and also instructs the uttered sound storage unit to store an uttered audio signal separated by the sound source separating unit 122. Upon the suppressed audio signal being output, the signal adding unit 17 reads out the uttered audio signal stored in the uttered sound storage unit and outputs the read-out uttered audio signal.

Through this configuration, an uttered audio signal input while a suppressed audio signal to be provided immediately is being output can be output, for example, after the suppressed audio signal has been output. Thus, the user can certainly hear the suppressed sound to be provided to the user and can certainly hear the conversation as well.

The suppressed sound output unit 16 may modify the frequency of a suppressed audio signal and output the result. The suppressed sound output unit 16 may continuously vary the phase of a suppressed audio signal and output the result. The audio processing apparatus 1 may further include a vibration unit that causes an earphone provided with the speaker 19 to vibrate in a case in which a suppressed sound is output through the speaker 19.

Second Embodiment

Subsequently, an audio processing apparatus according to a second embodiment will be described. In the first embodiment, a suppressed sound to be provided to the user is output directly. In the second embodiment, instead of a suppressed sound to be provided to the user being output directly, an informing sound informing that a suppressed sound to be provided to the user is present is output.

Figure 6:
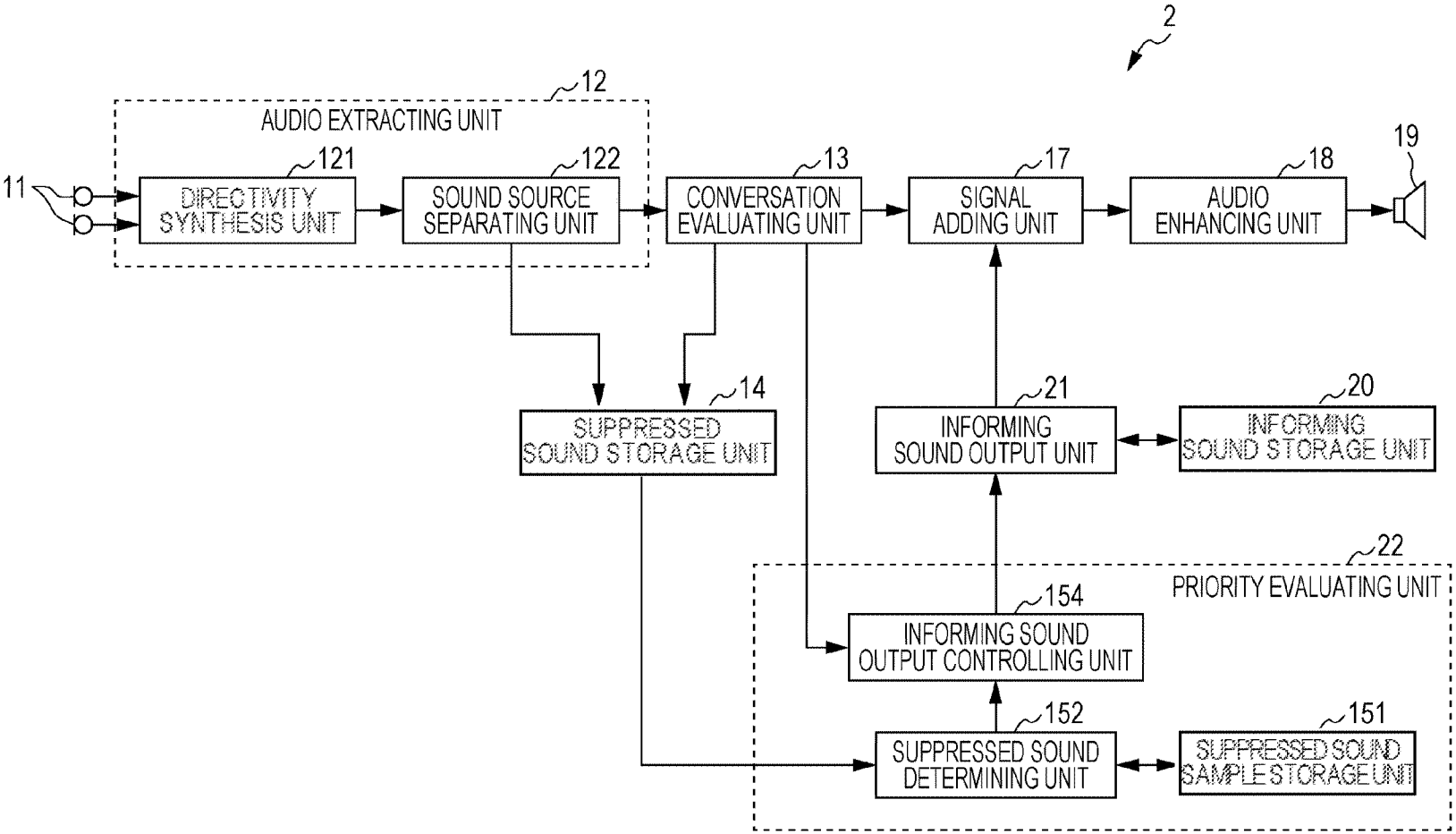
FIG. 6 illustrates a configuration of an audio processing apparatus according to a second embodiment.

FIG. 6 illustrates the configuration of the audio processing apparatus according to the second embodiment. An audio processing apparatus 2 is, for example, a hearing aid.

The audio processing apparatus 2 illustrated in FIG. 6 includes a microphone array 11, an audio extracting unit 12, a conversation evaluating unit 13, a suppressed sound storage unit 14, a signal adding unit 17, an audio enhancing unit 18, a speaker 19, an informing sound storage unit 20, an informing sound output unit 21, and a priority evaluating unit 22. In the following description, components that are identical to those of the first embodiment are given identical reference characters, and descriptions thereof will be omitted. Thus, only the configuration that differs from the first embodiment will be described.

The priority evaluating unit 22 includes a suppressed sound sample storage unit 151, a suppressed sound determining unit 152, and an informing sound output controlling unit 154.

The informing sound output controlling unit 154 determines whether an informing audio signal associated with a suppressed audio signal that the suppressed sound determining unit 152 has determined to be a suppressed audio signal indicating a sound to be provided to the user is to be output on the basis of the priority given to that suppressed audio signal, and also determines the timing at which the informing audio signal is to be output. The processing of controlling an output of an informing audio signal by the informing sound output controlling unit 154 is similar to the processing of controlling an output of a suppressed audio signal by the suppressed sound output controlling unit 153 according to the first embodiment, and thus detailed description thereof will be omitted.

The informing sound storage unit 20 stores an informing audio signal associated with a suppressed audio signal to be provided to the user. An informing audio signal is a sound for informing the user that a suppressed audio signal to be provided to the user has been input. For example, a suppressed audio signal indicating a telephone ring tone is associated with an informing audio signal that states "the telephone is ringing," and a suppressed audio signal indicating a vehicle engine sound is associated with an informing audio signal that states "a vehicle is approaching."

The informing sound output unit 21 reads out, from the informing sound storage unit 20, an informing audio signal associated with a suppressed audio signal to be provided to the user in response to an instruction from the informing sound output controlling unit 154 and outputs the read-out informing audio signal to the signal adding unit 17. The timing at which an informing audio signal is output in the second embodiment is identical to the timing at which a suppressed audio signal is output in the first embodiment.

Figure 7:
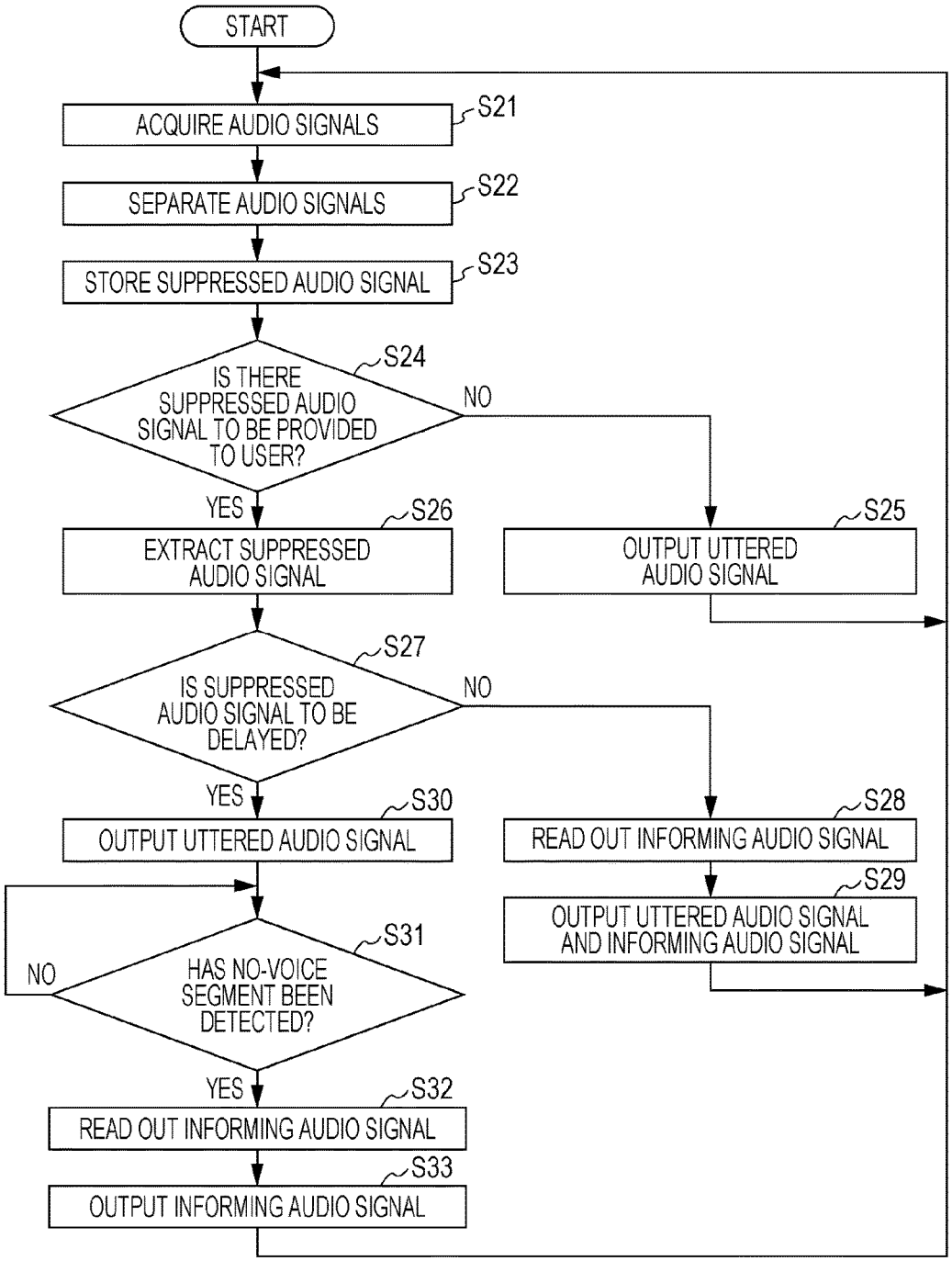
FIG. 7 is a flowchart for describing an exemplary operation of the audio processing apparatus according to the second embodiment.

FIG. 7 is a flowchart for describing an exemplary operation of the audio processing apparatus according to the second embodiment.

The processing in steps S21 to S27 illustrated in FIG. 7 is identical to the processing in steps S1 to S7 illustrated in FIG. 3, and thus descriptions thereof will be omitted.

If it is determined that the suppressed audio signal to be provided to the user is not to be delayed, the informing sound output controlling unit 154 instructs the informing sound output unit 21 to output the informing audio signal associated with the suppressed audio signal to be provided to the user that has been extracted in step S26.

If it is determined that the suppressed audio signal to be provided to the user is not to be delayed (NO in step S27), in step S28, the informing sound output unit 21 reads out, from the informing sound storage unit 20, the informing audio signal associated with the suppressed audio signal to be provided to the user that has been extracted in step S26. The informing sound output unit 21 outputs the read-out informing audio signal to the signal adding unit 17.

In step S29, the signal adding unit 17 outputs the uttered audio signal output from the conversation evaluating unit 13 and the informing audio signal output by the informing sound output unit 21. The audio enhancing unit 18 enhances the uttered audio signal and the informing audio signal, which have been output by the signal adding unit 17. The speaker 19 then converts the uttered audio signal and the informing audio signal, which have been enhanced by the audio enhancing unit 18, into an uttered sound and an informing sound, respectively, and outputs the converted uttered sound and informing sound. After the uttered sound and the informing sound are output, the processing returns to the process in step S21.

Meanwhile, if it is determined that the suppressed audio signal to be provided to the user is to be delayed (YES in step S27), in step S30, the signal adding unit 17 outputs only the uttered audio signal output from the conversation evaluating unit 13. The audio enhancing unit 18 enhances the uttered audio signal output by the signal adding unit 17. Then, the speaker 19 converts the uttered audio signal enhanced by the audio enhancing unit 18 into an uttered sound and outputs the converted uttered sound.

In step S31, the informing sound output controlling unit 154 determines whether a no-voice segment in which the user's conversation is not detected has been detected. The conversation evaluating unit 13 detects a no-voice segment extending from a point at which an output of an uttered audio signal finishes to a point at which a subsequent uttered audio signal is input. If a no-voice segment has been detected, the conversation evaluating unit 13 notifies the informing sound output controlling unit 154. When the informing sound output controlling unit 154 is notified by the conversation evaluating unit 13 that a no-voice segment has been detected, the informing sound output controlling unit 154 determines that a no-voice segment has been detected. If it is determined that a no-voice segment has been detected, the informing sound output controlling unit 154 instructs the informing sound output unit 21 to output the informing audio signal associated with the suppressed audio signal to be provided to the user that has been extracted in step S26. If it is determined that no no-voice segment has been detected (NO in step S31), the process in step S31 is repeated until a no-voice segment is detected.

If it is determined that a no-voice segment has been detected (YES in step S31), in step S32, the informing sound output unit 21 reads out, from the informing sound storage unit 20, the informing audio signal associated with the suppressed audio signal to be provided to the user that has been extracted in step S26. The informing sound output unit 21 outputs the read-out informing audio signal to the signal adding unit 17.

In step S33, the signal adding unit 17 outputs the informing audio signal output by the informing sound output unit 21. The audio enhancing unit 18 enhances the informing audio signal output by the signal adding unit 17. Then, the speaker 19 converts the informing audio signal enhanced by the audio enhancing unit 18 into an informing sound, and outputs the converted informing sound. After the informing sound is output, the processing returns to the process in step S21.

In this manner, instead of a suppressed sound to be provided to the user being output directly, an informing sound that informs the user that a suppressed sound to be provided to the user has been input is output, and thus the user can be informed of the circumstance surrounding the user that the user should be notified of.

In the second embodiment, when a suppressed audio signal to be provided to the user is present among the separated suppressed audio signals, an informing sound that informs the user that a suppressed sound to be provided to the user is present is output. The present disclosure, however, is not limited thereto, and when a suppressed audio signal to be provided to the user is present among the separated suppressed audio signals, an informing image that informs the user that a suppressed sound to be provided to the user is present may be displayed.

In this case, the audio processing apparatus 2 includes an informing image output controlling unit, an informing image storing unit, an informing image output unit, and a display unit, in place of the informing sound output controlling unit 154, the informing sound storage unit 20, and the informing sound output unit 21 of the second embodiment.

The informing image output controlling unit determines whether an informing image associated with a suppressed audio signal that the suppressed sound determining unit 152 has determined to be a suppressed audio signal indicating a sound to be provided to the user is to be output on the basis of the priority given to that suppressed audio signal, and also determines the timing at which the informing image is to be output.

The informing image storing unit stores an informing image associated with a suppressed audio signal to be provided to the user. An informing image is an image for informing the user that a suppressed audio signal to be provided to the user has been input. For example, a suppressed audio signal indicating a telephone ring tone is associated with an informing image that reads "the telephone is ringing," and a suppressed audio signal indicating a vehicle engine sound is associated with an informing image that reads "a vehicle is approaching."

The informing image output unit reads out, from the informing image storing unit, an informing image associated with a suppressed audio signal to be provided to the user in response to an instruction from the informing image output controlling unit and outputs the read-out informing image to the display unit. The display unit displays the informing image output by the informing image output unit.

An informing sound is represented in the form of a text indicating the content of a suppressed sound to be provided to the user in the present embodiment. The present disclosure, however, is not limited thereto, and an informing sound may be represented by a sound corresponding to the content of a suppressed sound to be provided to the user. Specifically, the informing sound storage unit 20 may store sounds that are associated in advance to the respective suppressed audio signals to be provided to the user, and the informing sound output unit 21 may read out, from the informing sound storage unit 20, a sound associated with a suppressed audio signal to be provided to the user and output the read-out sound.

Third Embodiment

Subsequently, an audio processing apparatus according to a third embodiment will be described. In the first and second embodiments, surrounding audio signals indicating sounds surrounding the user are separated into an uttered audio signal indicating a sound uttered by a person and a suppressed audio signal indicating a sound to be suppressed that is different from a sound uttered by a person. In the third embodiment, a reproduced audio signal reproduced from a sound source is output, a surrounding audio signal to be provided to the user is extracted from a surrounding audio signal indicating a sound surrounding the user, and the extracted surrounding audio signal is output.

Figure 8:
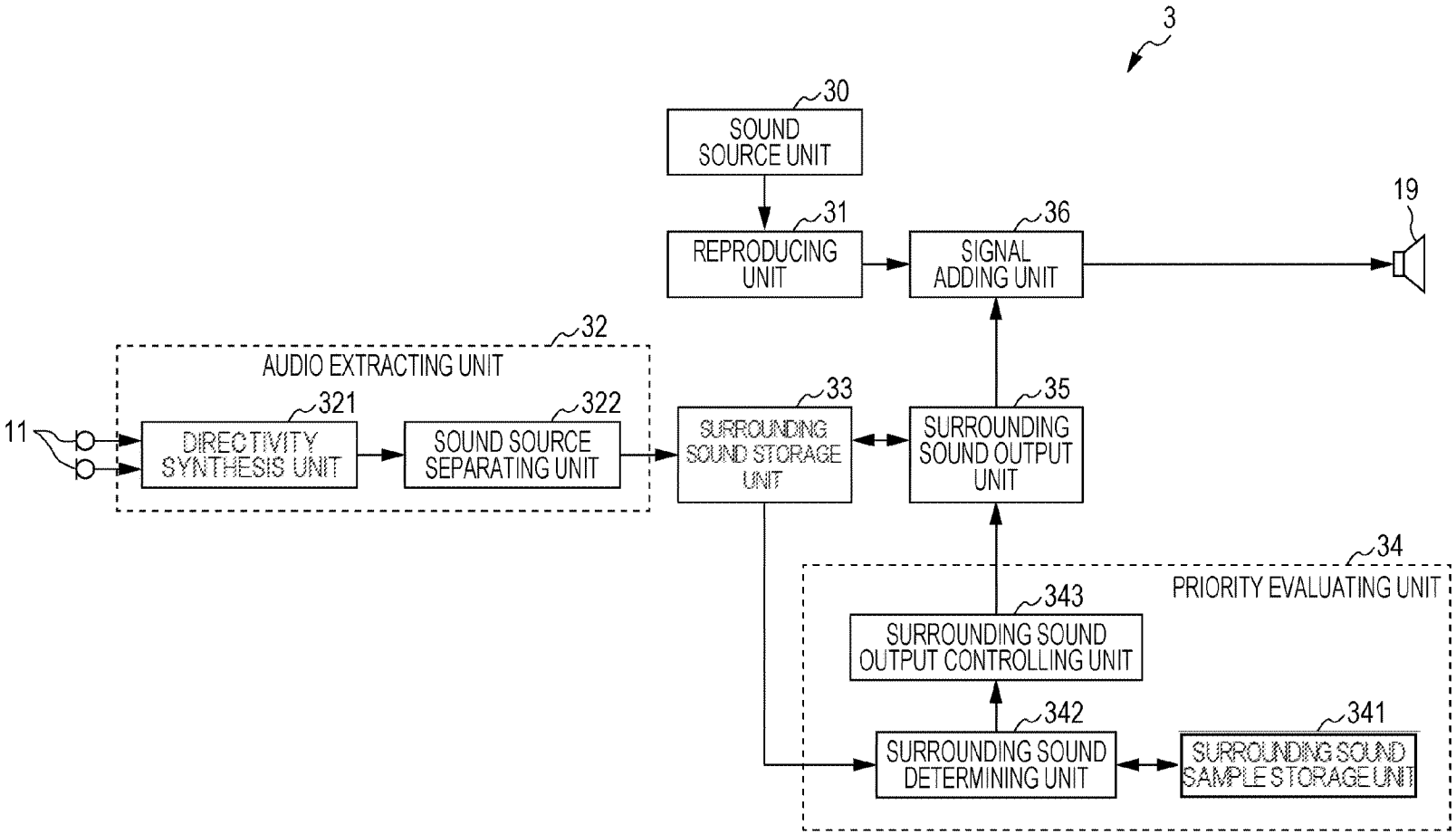
FIG. 8 illustrates a configuration of an audio processing apparatus according to a third embodiment.

FIG. 8 illustrates the configuration of the audio processing apparatus according to the third embodiment. An audio processing apparatus 3 is, for example, a portable music player or a radio broadcast receiver.

The audio processing apparatus 3 illustrated in FIG. 8 includes a microphone array 11, a sound source unit 30, a reproducing unit 31, an audio extracting unit 32, a surrounding sound storage unit 33, a priority evaluating unit 34, a surrounding sound output unit 35, a signal adding unit 36, and a speaker 19. In the following description, components that are identical to those of the first embodiment are given identical reference characters, and descriptions thereof will be omitted. Thus, only the configuration that differs from the first embodiment will be described.

The sound source unit 30 is constituted, for example, by a memory and stores an audio signal indicating a main sound. The main sound, for example, is music data. Alternatively, the sound source unit 30 may be constituted, for example, by a radio broadcast receiver, and the sound source unit 30 may receive a radio broadcast and convert the received radio broadcast into an audio signal. As another alternative, the sound source unit 30 may be constituted, for example, by a television broadcast receiver, and the sound source unit 30 may receive a television broadcast and convert the received television broadcast into an audio signal. As yet another alternative, the sound source unit 30 may be constituted, for example, by an optical disc drive and may read out an audio signal recorded on an optical disc.

The reproducing unit 31 reproduces an audio signal from the sound source unit 30 and outputs the reproduced audio signal.

The audio extracting unit 32 includes a directivity synthesis unit 321 and a sound source separating unit 322. The directivity synthesis unit 321 extracts, from a plurality of surrounding audio signals output from the microphone array 11, a plurality of surrounding audio signals output from the same sound source.

The sound source separating unit 322 separates the plurality of input surrounding audio signals in accordance with their sound sources through the blind sound source separation processing, for example.

The surrounding sound storage unit 33 stores a plurality of surrounding audio signals input from the sound source separating unit 322.

The priority evaluating unit 34 includes a surrounding sound sample storage unit 341, a surrounding sound determining unit 342, and a surrounding sound output controlling unit 343.

The surrounding sound sample storage unit 341 stores acoustic parameters indicating feature amounts of surrounding audio signals to be provided to the user for the respective surrounding audio signals. In addition, the surrounding sound sample storage unit 341 may store the priority associated with the acoustic parameters. A sound that is highly important (urgent) is given a high priority, whereas a sound that is not very important (urgent) is given a low priority. For example, a sound that should be provided to the user immediately even when the user is listening to a reproduced piece of music is given a first priority, whereas a sound that can wait until the reproduction of the music finishes is given a second priority, which is lower than the first priority. A sound that does not need to be provided to the user may be given a third priority, which is lower than the second priority. The surrounding sound sample storage unit 341 does not need to store an acoustic parameter of a sound that does not need to be provided to the user.

The surrounding sound determining unit 342 determines, among a plurality of surrounding audio signals stored in the surrounding sound storage unit 33, a surrounding audio signal indicating a sound to be provided to the user. The surrounding sound determining unit 342 extracts a surrounding audio signal indicating a sound to be provided to the user from the acquired surrounding audio signals. The surrounding sound determining unit 342 compares the acoustic parameters of the plurality of surrounding audio signals stored in the surrounding sound storage unit 33 with the acoustic parameters stored in the surrounding sound sample storage unit 341, and extracts, from the surrounding sound storage unit 33, a surrounding audio signal having an acoustic parameter similar to an acoustic parameter stored in the surrounding sound sample storage unit 341.

The surrounding sound output controlling unit 343 determines whether a surrounding audio signal that the surrounding sound determining unit 342 has determined to be the surrounding audio signal indicating a sound to be provided to the user is to be output on the basis of the priority given to that surrounding audio signal, and also determines the timing at which the surrounding audio signal is to be output. The surrounding sound output controlling unit 343 selects any one of a first output pattern in which a surrounding audio signal is output along with a reproduced audio signal without a delay, a second output pattern in which a surrounding audio signal is output with a delay after only a reproduced audio signal is output, and a third output pattern in which only a reproduced audio signal is output when no surrounding audio signal has been extracted.

When the first output pattern is selected, the surrounding sound output controlling unit 343 instructs the surrounding sound output unit 35 to output a surrounding audio signal. When the second output pattern is selected, the surrounding sound output controlling unit 343 determines whether the reproducing unit 31 has finished reproducing an audio signal. If it is determined that the reproduction of the audio signal has finished, the surrounding sound output controlling unit 343 instructs the surrounding sound output unit 35 to output a surrounding audio signal. When the third output pattern is selected, the surrounding sound output controlling unit 343 instructs the surrounding sound output unit 35 not to output a surrounding audio signal.

The surrounding sound output unit 35 outputs a surrounding audio signal in response to an instruction from the surrounding sound output controlling unit 343.

The signal adding unit 36 outputs a reproduced audio signal (first audio signal) read out from the sound source unit 30 and also outputs a surrounding audio signal (providing audio signal) to be provided to the user that has been extracted by the surrounding sound determining unit 342. The signal adding unit 36 combines (adds) a reproduced audio signal output from the reproducing unit 31 with a surrounding audio signal output by the surrounding sound output unit 35 and outputs the result. When the first output pattern is selected, the signal adding unit 36 outputs a surrounding audio signal along with a reproduced audio signal without a delay. When the second output pattern is selected, the signal adding unit 36 outputs a surrounding audio signal with a delay after only a reproduced audio signal is output. When the third output pattern is selected, the signal adding unit 36 outputs only a reproduced audio signal.

Figure 9:
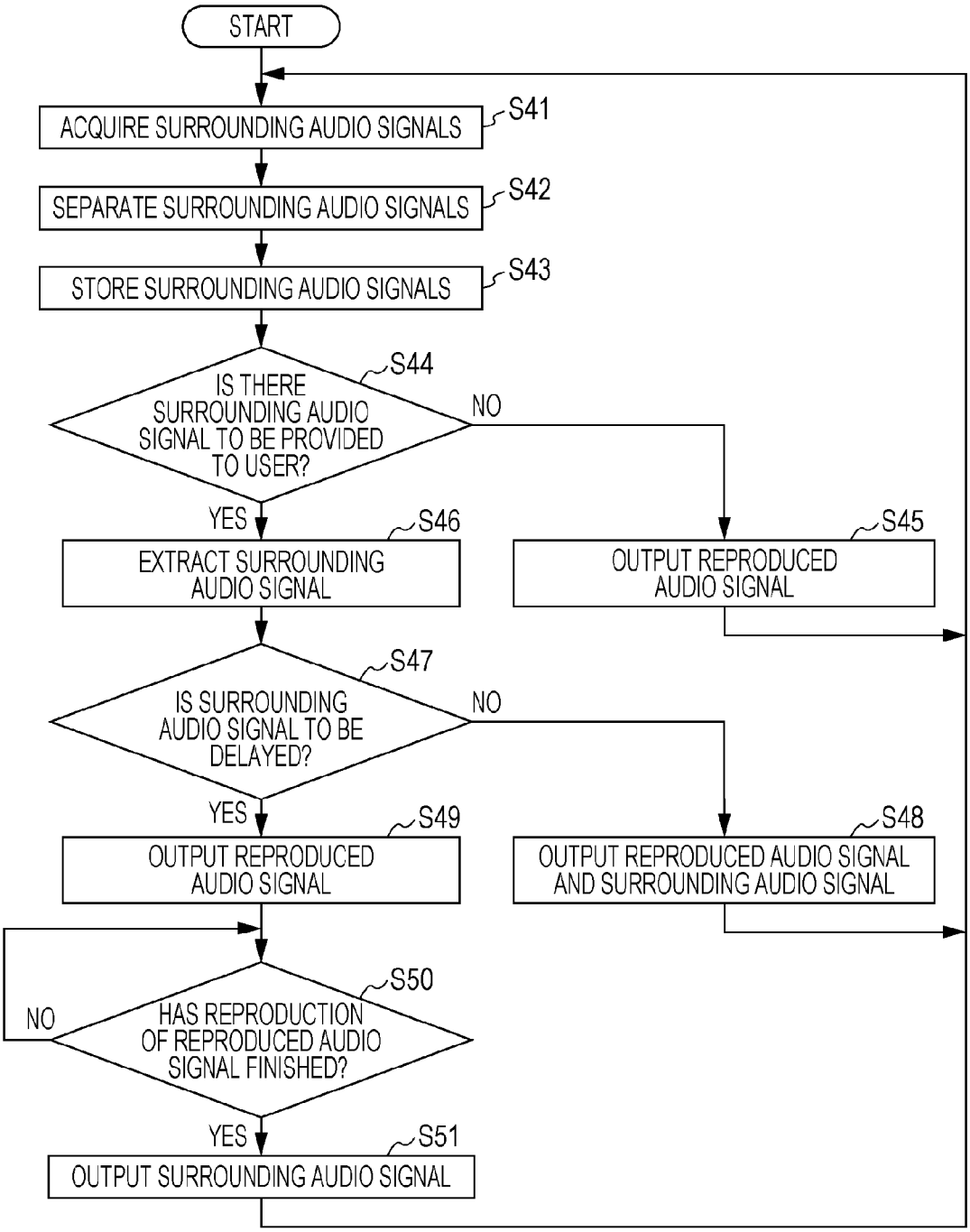
FIG. 9 is a flowchart for describing an exemplary operation of the audio processing apparatus according to the third embodiment.

FIG. 9 is a flowchart for describing an exemplary operation of the audio processing apparatus according to the third embodiment.

In step S41, the directivity synthesis unit 321 acquires surrounding audio signals converted by the microphone array 11. The surrounding audio signals indicate sounds surrounding the user (audio processing apparatus).

In step S42, the sound source separating unit 322 separates the acquired surrounding audio signals in accordance with their sound sources.

In step S43, the sound source separating unit 322 stores the separated surrounding audio signals into the surrounding sound storage unit 33.

In step S44, the surrounding sound determining unit 342 determines whether a surrounding audio signal to be provided to the user is present in the surrounding sound storage unit 33. The surrounding sound determining unit 342 compares the feature amount of an extracted surrounding audio signal with the feature amounts of the samples of the surrounding audio signals stored in the surrounding sound sample storage unit 341. When a surrounding audio signal having a feature amount similar to the feature amount of a sample of a surrounding audio signal stored in the surrounding sound sample storage unit 341 is present, the surrounding sound determining unit 342 determines that a surrounding audio signal to be provided to the user is present in the surrounding sound storage unit 33.

If it is determined that no surrounding audio signal to be provided to the user is present in the surrounding sound storage unit 33 (NO in step S44), in step S45, the signal adding unit 36 outputs only a reproduced audio signal output from the reproducing unit 31. Then, the speaker 19 converts the reproduced audio signal output by the signal adding unit 36 into a reproduced sound, and outputs the converted reproduced sound. After the reproduced sound is output, the processing returns to the process in step S41.

Meanwhile, if it is determined that a surrounding audio signal to be provided to the user is present in the surrounding sound storage unit 33 (YES in step S44), in step S46, the surrounding sound determining unit 342 extracts the surrounding audio signal to be provided to the user from the surrounding sound storage unit 33.

In step S47, the surrounding sound output controlling unit 343 determines whether the surrounding audio signal to be provided to the user that has been extracted by the surrounding sound determining unit 342 is to be delayed on the basis of the priority given to that surrounding audio signal. For example, when the priority given to the surrounding audio signal that has been determined to be the surrounding audio signal to be provided to the user is no less than a predetermined value, the surrounding sound output controlling unit 343 determines that the surrounding audio signal to be provided to the user is not to be delayed. Meanwhile, when the priority given to the surrounding audio signal that has been determined to be the surrounding audio signal to be provided to the user is less than the predetermined value, the surrounding sound output controlling unit 343 determines that the surrounding audio signal to be provided to the user is to be delayed.

If it is determined that the surrounding audio signal to be provided to the user is not to be delayed, the surrounding sound output controlling unit 343 instructs the surrounding sound output unit 35 to output the surrounding audio signal to be provided to the user that has been extracted in step S46. The surrounding sound output unit 35 outputs the surrounding audio signal to be provided to the user in response to the instruction from the surrounding sound output controlling unit 343.

If it is determined that the surrounding audio signal to be provided to the user is not to be delayed (NO in step S47), in step S48, the signal adding unit 36 outputs a reproduced audio signal output from the reproducing unit 31 and the surrounding audio signal to be provided to the user output by the surrounding sound output unit 35. Then, the speaker 19 converts the reproduced audio signal and the surrounding audio signal, which have been output by the signal adding unit 36, into a reproduced sound and a surrounding sound, respectively, and outputs the converted reproduced sound and surrounding sound. After the reproduced sound and the surrounding sound are output, the processing returns to the process in step S41.

Meanwhile, if it is determined that the surrounding audio signal to be provided to the user is to be delayed (YES in step S47), in step S49, the signal adding unit 36 outputs only a reproduced audio signal output from the reproducing unit 31. Then, the speaker 19 converts the reproduced audio signal output by the signal adding unit 36 into a reproduced sound and outputs the converted reproduced sound.

In step S50, the surrounding sound output controlling unit 343 determines whether the reproducing unit 31 has finished reproducing the reproduced audio signal. Upon finishing reproducing the reproduced audio signal, the reproducing unit 31 notifies the surrounding sound output controlling unit 343. When the surrounding sound output controlling unit 343 is notified by the reproducing unit 31 that the reproduction of the reproduced audio signal has finished, the surrounding sound output controlling unit 343 determines that the reproduction of the reproduced audio signal has finished. If it is determined that the reproduction of the reproduced audio signal has finished, the surrounding sound output controlling unit 343 instructs the surrounding sound output unit 35 to output the surrounding audio signal to be provided to the user that has been extracted in step S46. The surrounding sound output unit 35 outputs the surrounding audio signal to be provided to the user in response to the instruction from the surrounding sound output controlling unit 343. If it is determined that the reproduction of the reproduced audio signal has not finished (NO in step S50), the process in step S50 is repeated until the reproduction of the reproduced audio signal finishes.

Meanwhile, if it is determined that the reproduction of the reproduced audio signal has finished (YES in step S50), in step S51, the signal adding unit 36 outputs the surrounding audio signal to be provided to the user output by the surrounding sound output unit 35. Then, the speaker 19 converts the surrounding audio signal output by the signal adding unit 36 into a surrounding sound and outputs the converted surrounding sound. After the surrounding sound is output, the processing returns to the process in step S41.

The timing at which a surrounding sound is output in the third embodiment may be identical to the timing at which a suppressed sound is output in the first embodiment.

Fourth Embodiment

Subsequently, an audio processing apparatus according to a fourth embodiment will be described. In the third embodiment, a surrounding sound to be provided to the user is output directly. In the fourth embodiment, instead of a surrounding sound to be provided to the user being output directly, an informing sound informing the user that a surrounding sound to be provided to the user is present is output.

Figure 10:
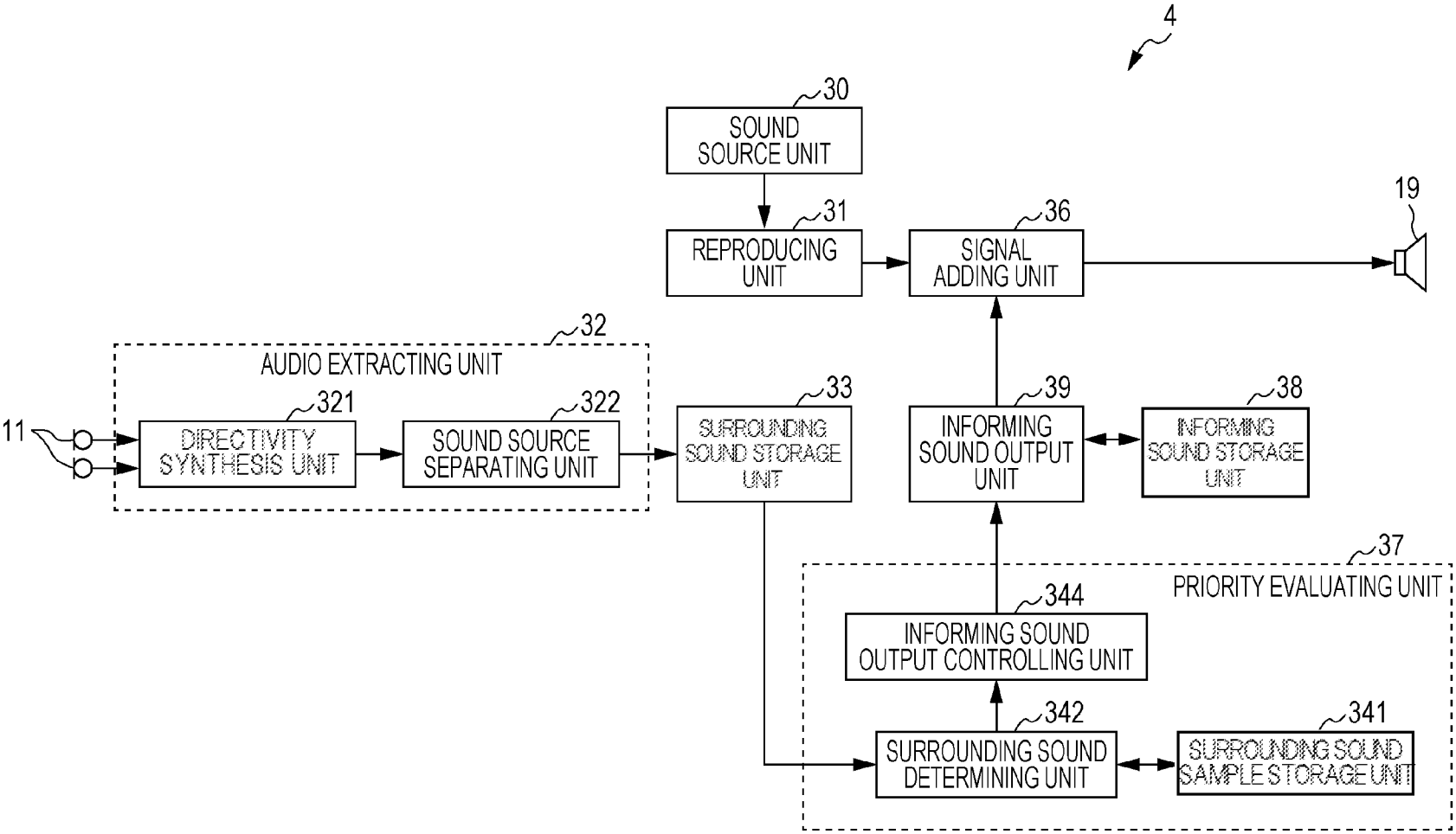
FIG. 10 illustrates a configuration of an audio processing apparatus according to a fourth embodiment.

FIG. 10 illustrates the configuration of the audio processing apparatus according to the fourth embodiment. An audio processing apparatus 4 is, for example, a portable music player or a radio broadcast receiver.

The audio processing apparatus 4 illustrated in FIG. 10 includes a microphone array 11, a speaker 19, a sound source unit 30, a reproducing unit 31, an audio extracting unit 32, a surrounding sound storage unit 33, a signal adding unit 36, a priority evaluating unit 37, an informing sound storage unit 38, and an informing sound output unit 39. In the following description, components that are identical to those of the third embodiment are given identical reference characters, and descriptions thereof will be omitted. Thus, only the configuration that differs from the third embodiment will be described.

The priority evaluating unit 37 includes a surrounding sound sample storage unit 341, a surrounding sound determining unit 342, and an informing sound output controlling unit 344.

The informing sound output controlling unit 344 determines whether an informing audio signal associated with a surrounding audio signal that the surrounding sound determining unit 342 has determined to be the surrounding audio signal indicating a sound to be provided to the user is to be output on the basis of the priority given to that surrounding audio signal, and also determines the timing at which the informing audio signal is to be output. The processing of controlling an output of an informing audio signal by the informing sound output controlling unit 344 is similar to the processing of controlling an output of a surrounding audio signal by the surrounding sound output controlling unit 343 in the third embodiment, and thus detailed descriptions thereof will be omitted.

The informing sound storage unit 38 stores an informing audio signal associated with a surrounding audio signal to be provided to the user. An informing audio signal is a sound for informing the user that a surrounding audio signal to be provided to the user has been input. For example, a surrounding audio signal indicating a telephone ring tone is associated with an informing audio signal that states "the telephone is ringing," and a surrounding audio signal indicating a vehicle engine sound is associated with an informing audio signal that states "a vehicle is approaching."

The informing sound output unit 39 reads out, from the informing sound storage unit 38, an informing audio signal associated with a surrounding audio signal to be provided to the user in response to an instruction from the informing sound output controlling unit 344, and outputs the read-out informing audio signal to the signal adding unit 36. The timing at which an informing audio signal is output in the fourth embodiment is identical to the timing at which a surrounding audio signal is output in the third embodiment.

Figure 11:
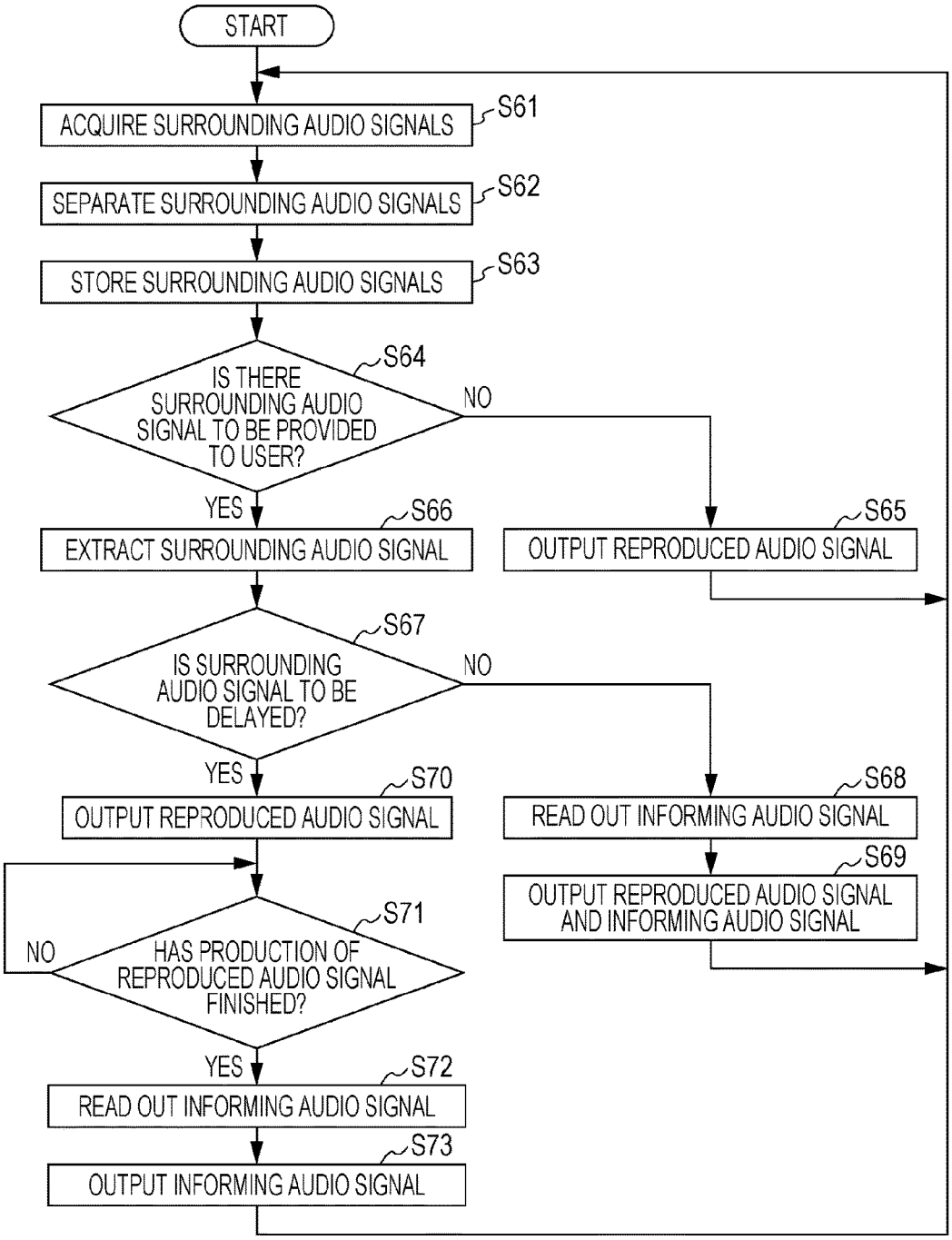
FIG. 11 is a flowchart for describing an exemplary operation of the audio processing apparatus according to the fourth embodiment.

FIG. 11 is a flowchart for describing an exemplary operation of the audio processing apparatus according to the fourth embodiment.

The processing in steps S61 to S67 illustrated in FIG. 11 is identical to the processing in steps S41 to S47 illustrated in FIG. 9, and thus descriptions thereof will be omitted.

If it is determined that the surrounding audio signal to be provided to the user is not to be delayed, the informing sound output controlling unit 344 instructs the informing sound output unit 39 to output the informing audio signal associated with the surrounding audio signal to be provided to the user that has been extracted in step S66.

If it is determined that the surrounding audio signal to be provided to the user is not to be delayed (NO in step S67), in step S68, the informing sound output unit 39 reads out, from the informing sound storage unit 38, the informing audio signal associated with the surrounding audio signal to be provided to the user that has been extracted in step S66. The informing sound output unit 39 outputs the read-out informing audio signal to the signal adding unit 36.

In step S69, the signal adding unit 36 outputs a reproduced audio signal output from the reproducing unit 31 and the informing audio signal output by the informing sound output unit 39. Then, the speaker 19 converts the reproduced audio signal and the informing audio signal, which have been output by the signal adding unit 36, into a reproduced sound and an informing sound, respectively, and outputs the converted reproduced sound and informing sound. After the reproduced sound and the informing sound are output, the processing returns to the process in step S61.

Meanwhile, if it is determined that the surrounding audio signal to be provided to the user is to be delayed (YES in step S67), in step S70, the signal adding unit 36 outputs only a reproduced audio signal output from the reproducing unit 31. Then, the speaker 19 converts the reproduced audio signal output by the signal adding unit 36 into a reproduced sound and outputs the converted reproduced sound.

In step S71, the informing sound output controlling unit 344 determines whether the reproducing unit 31 has finished reproducing the reproduced audio signal. Upon finishing reproducing the reproduced audio signal, the reproducing unit 31 notifies the informing sound output controlling unit 344. When the informing sound output controlling unit 344 is notified by the reproducing unit 31 that the reproduction of the reproduced audio signal has finished, the informing sound output controlling unit 344 determines that the reproduction of the reproduced audio signal has finished. When it is determined that the reproduction of the reproduced audio signal has finished, the informing sound output controlling unit 344 instructs the informing sound output unit 39 to output the informing audio signal associated with the surrounding audio signal to be provided to the user that has been extracted in step S66. If it is determined that the reproduction of the reproduced audio signal has not finished (NO in step S71), the process in step S71 is repeated until the reproduction of the reproduced audio signal finishes.

Meanwhile, if it is determined that the reproduction of the reproduced audio signal has finished (YES in step S71), in step S72, the informing sound output unit 39 reads out, from the informing sound storage unit 38, the informing audio signal associated with the surrounding audio signal to be provided to the user that has been extracted in step S66. The informing sound output unit 39 outputs the read-out informing audio signal to the signal adding unit 36.

In step S73, the signal adding unit 36 outputs the informing audio signal output by the informing sound output unit 39. Then, the speaker 19 converts the informing audio signal output by the signal adding unit 36 into an informing sound and outputs the converted informing sound. After the informing sound is output, the processing returns to the process in step S61.

In this manner, instead of a surrounding sound to be provided to the user being output directly, an informing sound that informs the user that a surrounding sound to be provided to the user has been input is output, and thus the user can be informed of the circumstance surrounding the user that the user should be notified of.

The audio processing apparatus, the audio processing method, and the non-transitory recording medium according to the present disclosure can output, among the sounds surrounding the user, a sound to be provided to a user, and are effective as an audio processing apparatus, an audio processing method, and a non-transitory recording medium that acquire audio signals indicating sounds surrounding the user and carry out predetermined processing on the acquired audio signals.

What is claimed is:

1. An audio processing apparatus, comprising:

an acquirer that acquires a surrounding audio signal indicating a sound surrounding a user;

an audio extractor that extracts, from the acquired surrounding audio signal, (1) a main sound that is output without delay, (2) a providing audio signal, including prioritized sounds other than the main signal, that is stored and selectably output with or without delay, and (3) sounds that are not stored and do not need to be output;

a selector that selects one of a plurality of output patterns of audio signals; and an output that outputs a first audio signal indicating a main sound and the providing audio signal, wherein the selector selects any one of (i) a first output pattern in which the providing audio signal is output along with the main sound without a delay, (ii) a second output pattern in which the providing audio signal is output with a delay after only the main sound is output, and (iii) a third output pattern in which only the main sound is output.

2. The audio processing apparatus according to claim 1, further comprising:

an audio separator that separates the acquired surrounding audio signal into the first audio signal and a second audio signal indicating a sound different from the main sound, wherein the audio extractor extracts the providing audio signal from the separated second audio signal, and wherein the output outputs the separated first audio and also outputs the extracted providing audio signal.

3. The audio processing apparatus according to claim 2, wherein the main sound includes a sound uttered by a person participating in a conversation.

4. The audio processing apparatus according to claim 1, further comprising:

an audio signal storage that stores the first audio signal in advance, wherein the output outputs the first audio signal read out from the audio signal storage and also outputs the extracted providing audio signal.

5. The audio processing apparatus according to claim 4, wherein the main sound includes music data.

6. The audio processing apparatus according to claim 1, further comprising:

a sample sound storage that stores a sample audio signal related to the providing audio signal, wherein the audio extractor compares a feature amount of the surrounding audio signal with a feature amount of the sample audio signal recorded in the sample sound storage, and extracts an audio signal having a feature amount similar to the feature amount of the sample audio signal as the providing audio signal.

7. The audio processing apparatus according to claim 1, wherein the audio processing apparatus further includes an audio output that outputs (i) the providing audio signal along with the first audio signal without a delay in a case in which the first output pattern is selected, (ii) the providing audio signal with a delay after outputting only the first audio signal in a case in which the second output pattern is selected, or (iii) only the first audio signal in a case in which the third output pattern is selected.

8. The audio processing apparatus according to claim 7, further comprising:

a no-voice segment detector that detects a no-voice segment extending from a point at which an output of the first audio signal finishes to a point at which a subsequent first audio signal is input, wherein, in a case in which the second output pattern is selected, the audio output determines whether the no-voice segment has been detected by the no-voice segment detector, and in a case in which it is determined that the no-voice segment has been detected, the audio output outputs the providing audio signal with the delay in the no-voice segment.

9. The audio processing apparatus according to claim 7, further comprising:

a speech rate detector that detects a rate of speech in the first audio signal, wherein, in a case in which the second output pattern is selected, the audio output determines whether the detected rate of speech is lower than a predetermined rate, and in a case in which it is determined that the rate of speech is lower than the predetermined rate, the audio output outputs the providing audio signal with the delay.

10. The audio processing apparatus according to claim 7, further comprising:

a no-voice segment detector that detects a no-voice segment extending from a point at which an output of the first audio signal finishes to a point at which a subsequent first audio signal is input, wherein, in a case in which the second output pattern is selected, the audio output determines whether the detected no-voice segment extends for or longer than a predetermined duration, and in a case in which it is determined that the no-voice segment extends for or longer than the predetermined duration, the audio output outputs the providing audio signal with the delay in the no-voice segment.

11. An audio processing method, comprising:

acquiring a surrounding audio signal indicating a sound surrounding a user;

extracting, from the acquired surrounding audio signal, (1) a main sound that is output without delay, (2) a providing audio signal, including prioritized sounds other than the main signal, that is stored and selectably output with or without delay, and (3) sounds that are not stored and do not need to be output;

selecting one of a plurality of output patterns of audio signals; and outputting a first audio signal indicating a main sound and the providing audio signal, wherein the selecting selects any one of (i) a first output pattern in which the providing audio signal is output along with the main sound without a delay, (ii) a second output pattern in which the providing audio signal is output with a delay after only the main sound is output, and (iii) a third output pattern in which only the main sound is output.

12. A non-transitory computer-readable recording medium having a program to be used in an audio processing apparatus recorded thereon, the program causing a computer of the audio processing apparatus to perform a method comprising:

acquiring a surrounding audio signal indicating a sound surrounding a user;

extracting, from the acquired surrounding audio signal, (1) a main sound that is output without delay, (2) a providing audio signal, including prioritized sounds other than the main signal, that is stored and selectably output with or without delay, and (3) sounds that are not stored and do not need to be output;

selecting one of a plurality of output patterns of audio signals; and outputting a first audio signal indicating a main sound and the providing audio signal, wherein the selecting selects any one of (i) a first output pattern in which the providing audio signal is output along with the main sound without a delay, (ii) a second output pattern in which the providing audio signal is output with a delay after only the main sound first audio signal is output, and (iii) a third output pattern in which only the main sound is output.

13. The audio processing apparatus according to claim 1, wherein the output outputs the extracted providing audio signal on a predetermined priority basis.

* * * * *